US008459573B2

(12) United States Patent
Wiseman et al.

(10) Patent No.: US 8,459,573 B2
(45) Date of Patent: Jun. 11, 2013

(54) SELECTABLE AND TWISTING NOZZLE FOR FLUID EFFECTS PLATFORM

(75) Inventors: Evelyn S. Wiseman, Long Beach, CA (US); Theodore R. Carlsson, Long Beach, CA (US); Jennifer Magill, Foothill Ranch, CA (US); Michael A. Layman, Huntington Beach, CA (US); William T. Slusser, Garden Grove, CA (US); Jason A. Badger, Anaheim, CA (US); Matthew A. Cotter, Orange, CA (US); Charles P. Davis, Fountain Valley, CA (US)

(73) Assignee: Disney Enterprises, Inc., Burbank, CA (US)

( * ) Notice: Subject to any disclaimer, the term of this patent is extended or adjusted under 35 U.S.C. 154(b) by 349 days.

(21) Appl. No.: 13/026,504

(22) Filed: Feb. 14, 2011

(65) Prior Publication Data

US 2011/0132994 A1 Jun. 9, 2011

Related U.S. Application Data

(63) Continuation-in-part of application No. 12/333,618, filed on Dec. 12, 2008, now Pat. No. 7,886,992.

(51) Int. Cl.

| | |
|---|---|
| ***B05B 7/08*** | (2006.01) |
| ***B05B 3/02*** | (2006.01) |
| ***B05B 3/00*** | (2006.01) |
| ***B05B 15/08*** | (2006.01) |

(52) U.S. Cl.

USPC ..... 239/17; 239/18; 239/243; 239/263.1; 239/264; 239/443; 239/447; 239/587.3

(58) Field of Classification Search

USPC ..... 239/12, 16–18, 20, 21, 71, 73, 101, 239/210, 225.1, 227, 243, 246, 263.1, 263.3, 239/264, 265, 436, 443, 447, 548, 587.1, 239/587.3, 587.5; 169/25

See application file for complete search history.

(56) References Cited

U.S. PATENT DOCUMENTS

| | | | | |
|---|---|---|---|---|
| 3,077,306 | A * | 2/1963 | Herzog | 239/227 |
| 4,955,540 | A * | 9/1990 | Fuller et al. | 239/20 |
| 4,986,476 | A * | 1/1991 | Hour | 239/227 |
| 6,053,423 | A * | 4/2000 | Jacobsen et al. | 239/18 |
| 6,131,819 | A * | 10/2000 | Fuller et al. | 239/20 |

FOREIGN PATENT DOCUMENTS

| | | |
|---|---|---|
| JP | 57-29254 | 7/1955 |
| JP | 58223584 A | 12/1983 |
| JP | 7-24463 | 5/1995 |
| JP | 08-141458 | 4/1996 |
| JP | 09-314305 | 9/1997 |
| JP | 2000-162997 | 6/2000 |

OTHER PUBLICATIONS

English translation of Office Action for Japanese Patent Application No. 2009-277508, forwarding date Sep. 27, 2011; also English abstracts of JP 5-54312, JP 58-223584 and JP 57-29254.

* cited by examiner

*Primary Examiner* — Darren W Gorman

(74) *Attorney, Agent, or Firm* — Marsh Fischmann & Breyfogle, LLP; Kent A. Lembke

(57) ABSTRACT

A fluid effects apparatus for producing a water display or show. The apparatus includes a base with a center point gimbal mechanism and a fluid outlet manifold with an inlet for receiving fluid. The fluid outlet manifold is pivotally supported upon the center point gimbal mechanism and includes a nozzle manifold with a pivotally mounted nozzle for dispersing the received fluid and a nozzle drive assembly coupled to the nozzle that selectively rotates the nozzle about its rotation axis. The drive assembly includes a motor mounted to pivot with the fluid outlet manifold upon the center point gimbal. The drive assembly includes an output drive element of the motor that is coupled to the nozzle to selectively rotate the nozzle. The nozzle manifold includes a second nozzle and switching means for selectively directing the received fluid to one of the two nozzles.

32 Claims, 15 Drawing Sheets

SELECTABLE AND TWISTING NOZZLE FOR FLUID EFFECTS PLATFORM

CROSS-REFERENCE TO RELATED APPLICATIONS

This application is a continuation-in-part of U.S. patent application Ser. No. 12/333,618, filed Dec. 12, 2008, which is incorporated herein by reference in its entirety.

BACKGROUND

1. Field of the Description

The present description relates, in general, to platforms or stages for positioning show or display effects or payloads such as show lights and nozzles for discharging fluid for a water display or fountain, and, more particularly, to a fluid effects platform or stage that is adapted for accurately discharging or dispersing water, flammable fluids, and/or other fluids and the platform or stage may utilize an output manifold that is pivotally mounted to allow positioning in numerous positions.

2. Relevant Background

There is a growing demand for large shows or displays that can be used to entertain audiences and to attract people to particular buildings or locations. Water displays and fountains are often used to create large and breathtaking shows with water and lights that are often accompanied by music being used in a variety of ways to create a crowd-pleasing effect. The water displays are becoming increasingly sophisticated and complicated in design and operation with most water displays including a body of water such as a pool or lake and numerous remotely-controlled nozzles and/or water display devices. The water display devices are often computer controlled to spray or disperse water in a timed or synchronized pattern. Presently-available water display systems have produced useful water displays and shows, but there have been many barriers toward their more widespread adoption and use.

Existing water display devices are typically submerged in a body of water and may be fixed in place or provided on a movable platform. The movable platform is typically raised and lowered by other submerged components to bring the nozzle or water outlet above the surface of the water during the show, and the movable platform is often quite large such as a 5 to 10 foot square platform that contains the nozzle and lighting and other portions of the water display device. Since the platform and device are large, they are often heavy and require relatively bulky equipment to raise and lower in the water.

Another problem facing water display designers is how to provide a moving head or nozzle system that can articulate to numerous positions such as up to 110 degrees in any direction. Such a range of nozzle or water outlet positions is desirable for providing displays and shows with greater variety and allows designers to play with the water to create different looks utilizing fewer fountains or water display devices (and, hence, fewer platforms that have to be raised and lowered in the water). Existing devices typically use a single hose to provide water to a nozzle that is mounted on a platform with or without lights. The platform is generally designed to move the nozzle using two assemblies that can be rotated about two separate, perpendicular axes (e.g., rotate about an X-axis and a Y-axis). Such systems allow the direction of the nozzle to be controlled, but these assemblies are generally large and heavy.

Another problem with existing water display systems is alignment of the outlet or nozzle prior to beginning a show or display sequence. For the designed effect to work, it is generally preferable for the nozzle to be returned to a home position such as vertical or with the nozzle pointing upwards. With existing fountains and water displays, the alignment process is very labor intensive and inaccurate as workers generally enter the pond or body of water and try to set the nozzle to a home position by hand. Often, this simply involves "eyeballing" the position of the nozzle to reset it into a desired position while standing in water on a platform or in a boat. Such aligning is then repeated periodically as the equipment may tend to become unaligned with use in shows.

Hence, there remains a need for water or fluid display systems that allow a nozzle or other outlet to be articulated such as up to 110 degrees in an arc. Preferably, such systems would significantly reduce the overall dimensions or size of the outlet positioning equipment and lower the load that needs to be raised and lowered in the water (e.g., to 250 pounds or the like). Additionally, it would be desirable for the fluid display system to include an improved mechanism for aligning the outlet or nozzle or placing it in a home or known position.

SUMMARY

The present description addresses the above problems by providing a compact water or fluid effects assembly with fewer moving parts. One assembly of the invention includes a fluid inlet manifold (or base) with a center point gimbal (e.g., a ball joint or the like) positioned at or near its top. A fluid outlet manifold with a nozzle or other outlet device is directly and, typically, rigidly connected to the center point gimbal such that the outlet manifold is pivotally mounted and may move in any direction from its center axis (e.g., when it is attached at about a center line to the ball joint or other gimbal device). A drive assembly is included in the effects assembly and includes a pair of drive mechanisms such as submersible servos that function concurrently or independently to move a pair of push/pull rods that are attached to the fluid outlet manifold. The push/pull rods are offset such as 120 degrees from each other as measured from the center axis of the fluid outlet manifold and may be used to push or pull on the manifold to cause it to pivot on the gimbal support so as to accurately position the nozzle (e.g., sweep the nozzle up to 55 degrees or more in any direction from the center axis). A self-dressing or managing hose assembly may be used to connect the inlet manifold to the outlet manifold, and the hose assembly may include a pair of flexible loops of hose extending in a crossing and symmetric fashion between the manifolds to balance application of loads during flow of fluid and movement of the outlet manifold by the drive assembly. In this manner, a fluid effects assembly that may be relatively small (e.g., less than about 3 feet in height and diameter) may be used in place of existing fountain display devices that were typically much larger and bulky with numerous moving parts.

More particularly, a fluid effects apparatus is provided that may be used as part of a show system or fountain to produce a water or other fluid display or special effect. The apparatus includes a base with a center point gimbal mechanism and a fluid outlet manifold with an inlet for receiving fluid. Significantly, the fluid outlet manifold is pivotally supported upon the center point gimbal mechanism and the fluid outlet manifold includes: a nozzle manifold with a fluid outlet for dispersing the received fluid; a nozzle pivotally attached to the fluid outlet; and a nozzle drive assembly coupled to the nozzle and operating to selectively rotate the nozzle about a rotation axis passing through the nozzle.

In some embodiments, the nozzle drive assembly includes a motor that is rigidly supported within the fluid outlet manifold (such as to the body of the nozzle manifold) to pivot with the fluid outlet manifold upon the center point gimbal. An output drive element of the motor is coupled via a drive member to the nozzle (or its pivotally attached inlet). The nozzle may be selectively rotatable through a full 360-degree rotation about the rotation axis by the motor, e.g., in a continuous twisting or rotating motion, alternating between clockwise and counterclockwise direction, and the like.

FIGS. 13-15 show the addition of this rotation feature on the nozzle output that allows rotation of the fluid output. When used, this allows the nozzle to spin in a continuous 360 degree movement while being moved about in the 110 degree range-of-freedom by the device. This servo is set up to index and synchronize with other units, which allows for other effects from the fountain such as a helix fountain as shown in FIG. 13 or a spinning flat fan moving in space.

The figures and discussion may stress the effects platform's benefits when used with fluid nozzles such as water or a moving flame head, but many other uses will be readily apparent for the pivotal effects platform. For example, the device may be used with a non-fluid flame, for using in positioning moving lights, for positioning a confetti cannon, for a pyrotechnic launches, for industrial/factory applications, and the like that may or may not involve fluid and nozzles.

The nozzle manifold further may include a second fluid outlet, a second nozzle coupled to the second fluid outlet, and switching means for selectively directing the received fluid to one of the fluid outlet and the second fluid outlet. In some cases, the switching means may include a controller positioned remote to the fluid outlet manifold that operates to select either the nozzle or the second nozzle for discharging the received fluid from the fluid outlet manifold, e.g., by transmitting wired or wireless signals to one or more control valves of a pressurized air inlet/feed manifold to nozzle switches in the nozzle manifold that operate a valve/diverter to direct received fluid to one of the two outlets of the nozzle manifold.

The apparatus also may include a drive assembly with first and second drive mechanisms (e.g., submersible servo motors or the like) that each drive input arms or elements that are attached to the fluid outlet manifold at an angular offset such as about 120 degrees. The drive mechanisms are separately and concurrently operable to move the input arms (such as by applying an input force along a linear path with these paths offset by the angular offset) to pivot the fluid outlet manifold on the center point gimbal mechanism to selectively position the outlet device. The outlet device or nozzle may have a range of motion on or about the center point gimbal mechanism that is defined by an angular offset in all directions from a center axis extending through the outlet device, e.g., up to 55 degrees or more in all directions such that a nozzle may be swept or articulated in an arc of up to 110 degrees or more in any direction (or 360 degrees of freedom). The base may include a fluid inlet manifold with an inlet for receiving pressurized fluid and two outlets for discharging the received pressurized fluid, and the base may further include two flexible hoses connecting the two outlets to the inlet of the fluid outlet manifold. The hoses may be self-managing in their arrangement and have a center of gravity that is positioned at an offset angle of about 120 degrees from the input arms of the drive mechanisms.

DETAILED DESCRIPTION OF THE PREFERRED EMBODIMENTS

Figure 1:
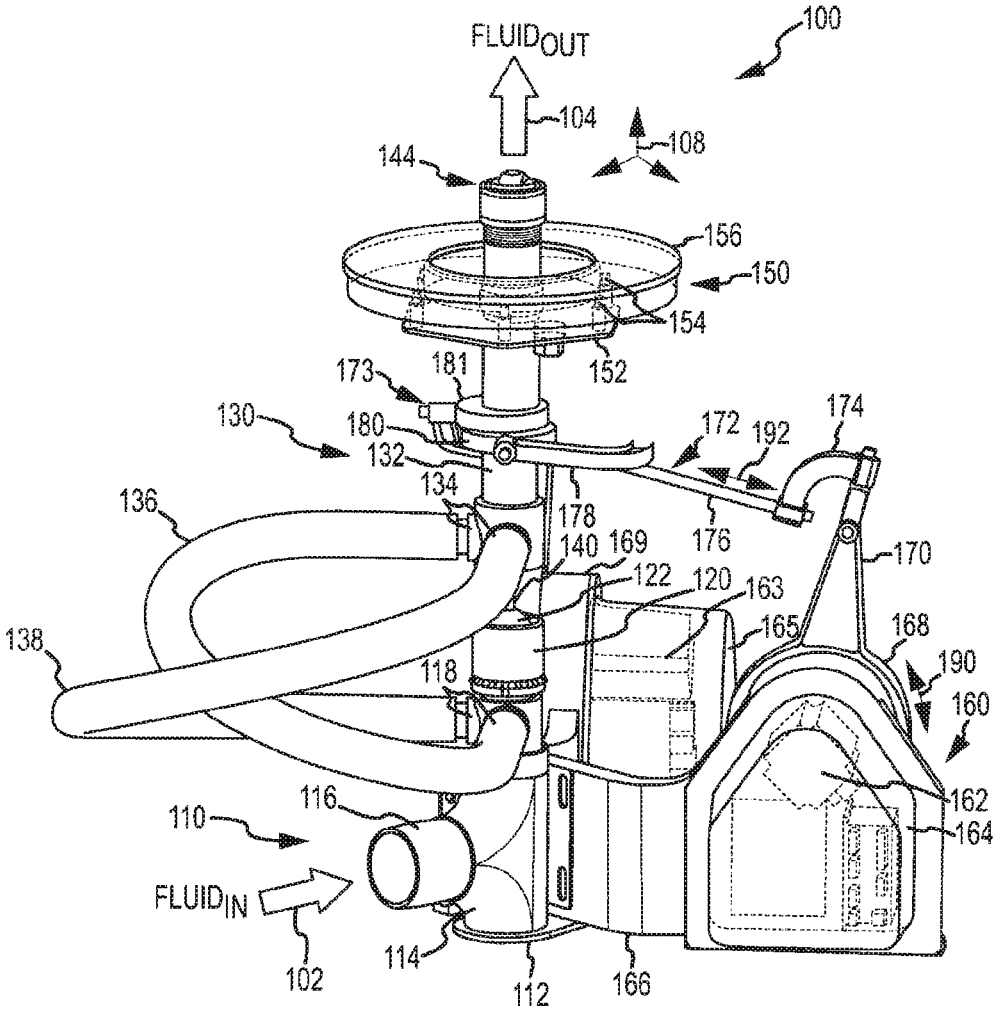
FIG. 1 illustrates a side perspective view of a fluid effects platform or stage of an embodiment of the invention, which may also be labeled a water/fluid display or fountain assembly.

Briefly, embodiments of the present invention are directed to a water display or fountain device that provides a nozzle or outlet device that can be articulated with three degrees of freedom. In some embodiments, it was desired that the nozzle be able to move about 50 to 60 degrees off center in all directions, with center typically being a vertical axis such that the nozzle is directed upward. To this end, embodiments of water display devices described herein provide an outlet manifold that is pivotally mounted on a center point gimbal such as upon a single ball joint or the like, and such mounting allows the outlet manifold to move in multiple directions. Two or more drive arms are connected to the outlet manifold to selectively position the outlet manifold, which typically includes a nozzle or other fluid discharge device, with some embodiments being adapted such that the nozzle may be positioned in or sweep through the 3D space associated with an inverted cone with its point at or near the pivot mounting mechanism. For example, a pair of drive arms may be attached to the outlet manifold with a 120 degree offset from each other and be operated by drive mechanisms such as submersible servo motors to position the outlet manifold or to select a position for the nozzle within the cone (e.g., a conical position of the nozzle of up to 55 degrees, for example, off of a center axis in any direction). The water display device may be adapted with an inclinometer such that zero inclination (or vertical/center) can be determined with respect to gravity and the nozzle can be returned to this home position.

A water display or fountain system may include numerous water display devices to create a synchronized show with enhanced movement and/or positioning resolution of the nozzles. The display devices may be used to accurately disperse nearly any fluid with water being just one exemplary use of the display devices described herein. For example, the display devices may be used to disperse flammable fluids. Further, the display devices may also be thought of as fluid effects platforms or stages as nearly any arrangement of components may be provided in the outlet manifold or assembly, and the following figures show a single water nozzle with a lighting assembly but the outlet manifold or assembly may include different discharge mechanisms, two or more nozzles for discharging one or more fluids concurrently or separately, or other equipment useful for creating a particular show or display effect.

FIGS. 1-4 illustrate a fluid effects platform or fluid display assembly 100, which may be used independently or, more typically, together with a number of other fluid effect platforms to provide a fluid display or show. The fluid display assembly 100 includes a fluid inlet manifold 110 and a fluid outlet manifold 130, which, as will be discussed in detail below, is pivotally mounted to the inlet manifold 110 via a center point gimbal. In the illustrated example, this multi-directional gimbal is provided with a ball joint 122 positioned in receiver or support 120 at the top of the inlet manifold 110 and the outlet manifold 130 is directly and rigidly attached to the ball joint 122 with connector or rod 140 such that the outlet manifold 130 is supported by the ball joint 122 and is able to pivot in multiple directions as the ball joint rotates/moves in support 120. A drive assembly 160 is provided in the fluid display assembly 100 to selectively position the outlet manifold 130, with the multi-direction movement/positioning shown with arrows 108.

Figure 7:
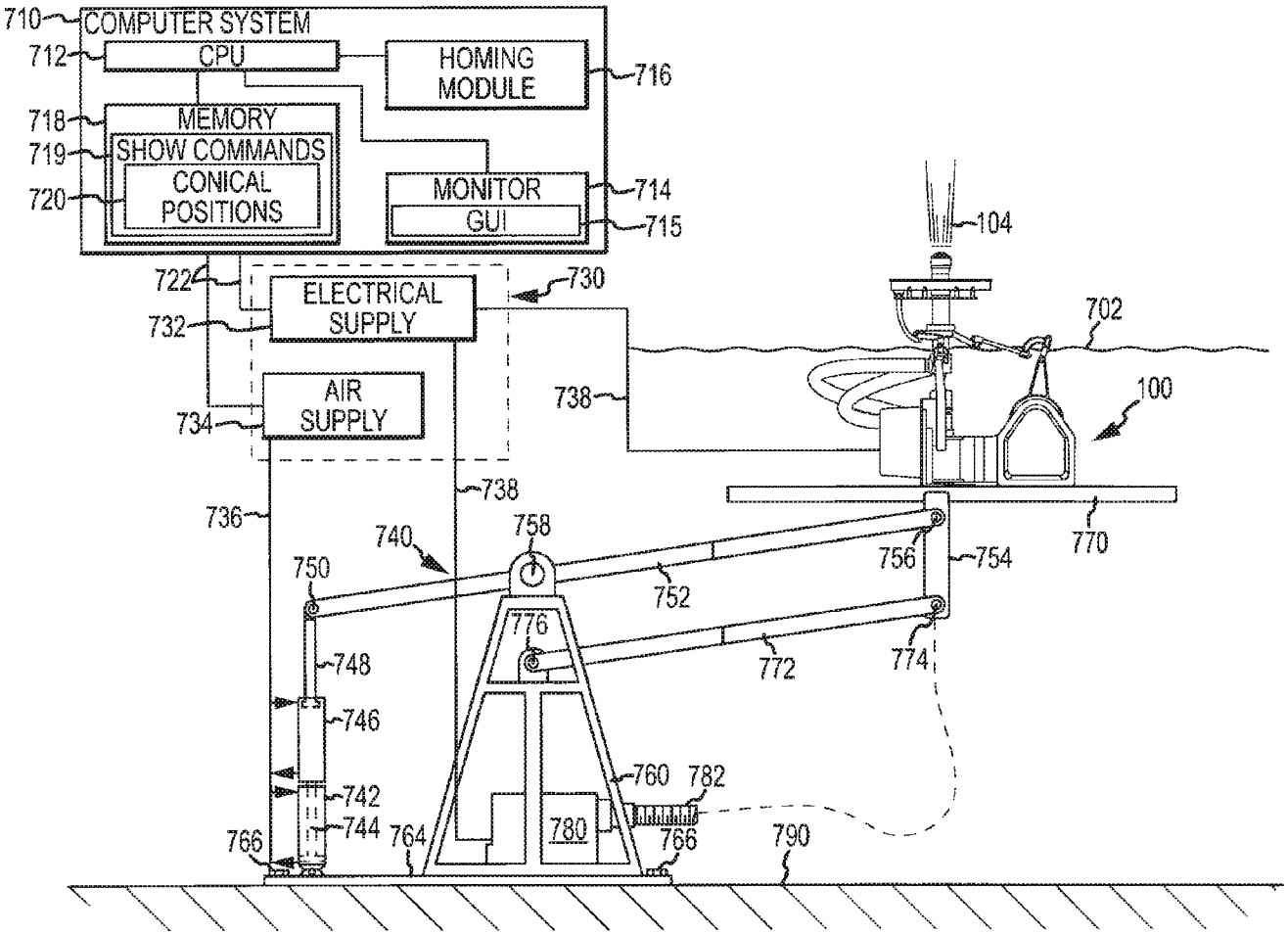
FIG. 7 provides a schematic illustration of a water display or fountain system including components to adjust the physical position of a water display device or fluid effects platform (such as the devices of FIGS. 1-6 or the like) and to remotely control operation of the water display device including positioning of a nozzle within a predefined conical space (in other cases, differing support assemblies may be used as shown in FIGS. 10A-10C)

The inlet manifold 110 includes a base 112 such as a plate that may be adapted for mounting the assembly 100 to another structure such as to a support structure within a body of water or to a platform or other structural member of a positioning mechanism (e.g., to a positionable platform 770 as shown in FIG. 7 that can be raised and lowered such as within a body of water to position the assembly at differing heights relative to a surface of the water 702). The assembly 100 is typically fixed to another structure such that it remains stable when fluid 104 is discharged at high pressure and rates. The inlet manifold 110 also includes a body 114 with fluid channels or passageways and an inlet 116 through which fluid 102 is pumped into the body 114 during operation of the assembly 100 to disperse fluid 104 from the outlet manifold 130. For example, a hose extending from a source of fluid (such as, but not limited to, a pump) may be attached to or clamped onto the inlet 116 to provide the fluid 102 to the inlet manifold 110. The inlet manifold 110 further includes one or more outlets 118 for the fluid 102 to be transmitted to the outlet manifold 130, with two outlets 118 being shown in this example assembly 100. Additionally, the inlet manifold 110 includes a receiver or support element 120 for supporting and containing the ball joint 122 while allowing it to move/pivot within the receiver 120. The fluid 102 is directed through the outlets 118 and is sealed from flowing to receiver 120 (e.g., with an end wall or cap that is in turn attached to the receiver 120 such as through a threaded connection, welding, or the like or the manifold with the receiver 120 may be formed as a unitary component such as via molding).

The fluid outlet manifold 130 is attached to and supported (in part) by the ball joint 122 via connector aim or rod 140. In this manner, the outlet manifold 130 is pivotally supported and mounted within the assembly 100 such that it can move in any direction relative to a longitudinal or central axis extending through the manifold 130 with range of movement being limited and/or controlled by the other portions of the assembly 100 including the drive assembly 160 and fluid tubing 136, 138. Hose management can be problematic with fountain and display devices with moving nozzles and components. Also, the hose or tubing such as tubing or hoses 136, 138 can become relatively heavy when they are filled with water, and this weight can cause loading and/or balance issues. These issues are addressed in the assembly 100 by providing two fluid transfer or feed hoses or lines 136, 138 (but a greater or smaller number may be used in some embodiments) with the arched or bowed arrangement shown in FIGS. 1-4.

The hoses 136, 138 are paired and offset from each other in location to provide symmetric loading or movement resistance/assistance to the outlet manifold 130. In other words, the hoses 136, 138 may be considered "self-dressing" or self-managing of load in part due to the loop configuration, and the hoses 136, 138 are also generally positioned at an angular offset from drive arms/rods 172, 173. In one embodiment, the balance of the assembly 100 is enhanced by providing hoses 136, 138 with a center of gravity about 120 degrees offset (as measured about a center axis of the manifold) from each of the drive arms/rods 172, 173 (which, in turn, are offset from each other by 120 degrees). The hoses 136, 138 are made of a flexible material such as reinforced rubber or plastic, with one embodiment using 2-inch PVC hose, and selected to withstand the operating pressures and flow rates of the assembly 100, which may be relatively high to achieve desired fluid displays or effects. The hoses 136, 138 are each connected at a first end to the inlet manifold 110 at outlets 118 and at a second end to the fluid outlet manifold 130 at fluid inlets 134 in body 132. The arrangement of the hoses or the hose configuration is believed highly beneficial to the assembly 100, as the hose configuration provides complete freedom of motion with a minimum of hose length and movement and with no stress or wear on the hoses 136, 138.

The body 132 is rigidly attached to or connected to the connector arm or rod 140 such that the body 132 is interconnected with the pivot member (e.g., ball joint) 122. The body 132 includes channels or passageways for allowing fluid received from the hoses 136, 138 to flow through the body 132 and to an outlet device 144 (e.g., a fluid nozzle or the like attached to or provided as part of the body 132) where it is dispersed or discharged as shown at 104. The outlet manifold 130 may take many forms to practice the invention such as the elongate body 132 as shown, and a single nozzle or outlet/discharge device 144 may be provided at the end of the body 132 or two or more of such devices 144 may be provided. In addition to discharging fluid, the assembly 100 may allow other payload to be positioned by pivoting the body 132. For example, as shown, a light ring or assembly 150 may be attached to the body 132 (or otherwise supported by outlet manifold 130) via plate or collar 152. Lights 154 such as LEDs or the like may be positioned on this plate 152 and an optional light output element 156 covering the lights 154, and the lights 154 may be powered with a local power source or a remote source (e.g., power typically will be run to or provided to drives 162, 163 and may also be provided to lights 154). The lights 154 are typically remotely controlled/operated such as in a manner that is synchronized with discharge of fluid 104 to create a desired light/fluid effect or display (e.g., see computer system 710 of FIG. 7 that may be used to control operation of the lights 154 in ring 150). In some embodiments, the fluid 104 is flammable and the payload provided on the stage or assembly 100 may include ignition devices (not shown) to ignite the fluid 104 as it is discharged from the outlet 144.

The fluid display assembly 100 includes a drive assembly 160 to selectively position the outlet manifold 130 and attached nozzle 144. As will be discussed with reference to FIGS. 5 and 6, the body 132 of outlet manifold 130 is pivoted on ball joint 122 such that the nozzle 144 and manifold 130 can be moved up to some predefined amount or angle in any direction from center (e.g., the home position shown with the body 132 and nozzle 144 generally pointing up or vertical), e.g., up to 55 to 60 degrees or more in all directions. The body 132 and nozzle 144 may be thought of as sweeping an inverted cone about the pivot connection or the nozzle may be thought of as being articulated up to 110 to 120 degrees or more in an arc. In some embodiments, the positioning of the body 132 and attached nozzle 144 is set by conical positions or 3D coordinates that are used to operate the drive assembly 160 to position the nozzle 144.

The drive assembly 160 is configured to drive or position the outlet manifold 130 with input forces provided at opposing axes separated by an offset angle, θ, which may vary to practice the invention. In one embodiment, the offset angle, θ, between the input or driving forces is set at 120 degrees (plus or minus 10 degrees). This provides a balanced or symmetric application of loads and allows the outlet manifold 130 to be positioned accurately in any position within a 3D conical space.

As shown, the drive assembly 160 includes first and second drive mechanisms 162, 163, which may be DC servo motors. AC stepper motors, or the like. The drive mechanisms 162, 163 may be specially adapted for submersion and/or are placed inside sealed housings 164, 165, which are attached to the inlet body 114 with wing elements or connectors 166, 167. At the motor/drive outputs, a drive plate 168, 169 is provided that rotates 190, 191 in response to operation of the motors or drive mechanisms 162, 163, and an extension 170, 171 protrudes from the plate 168, 169 to allow this rotational movement to be translated into a linear movement/motion 192, 193 that can be applied to the manifold body 132 to position the outlet manifold 130. The positioning or driving force is applied to the manifold 130 via positioning assemblies 172, 173, which as shown may generally be thought of as a pair of push/pull rods 172, 173 that are connected to the rotating drives 162, 163 via curved arms 174, 175, swing aims 176, 177, 178, 179, and collars 180, 181.

Figure 2:
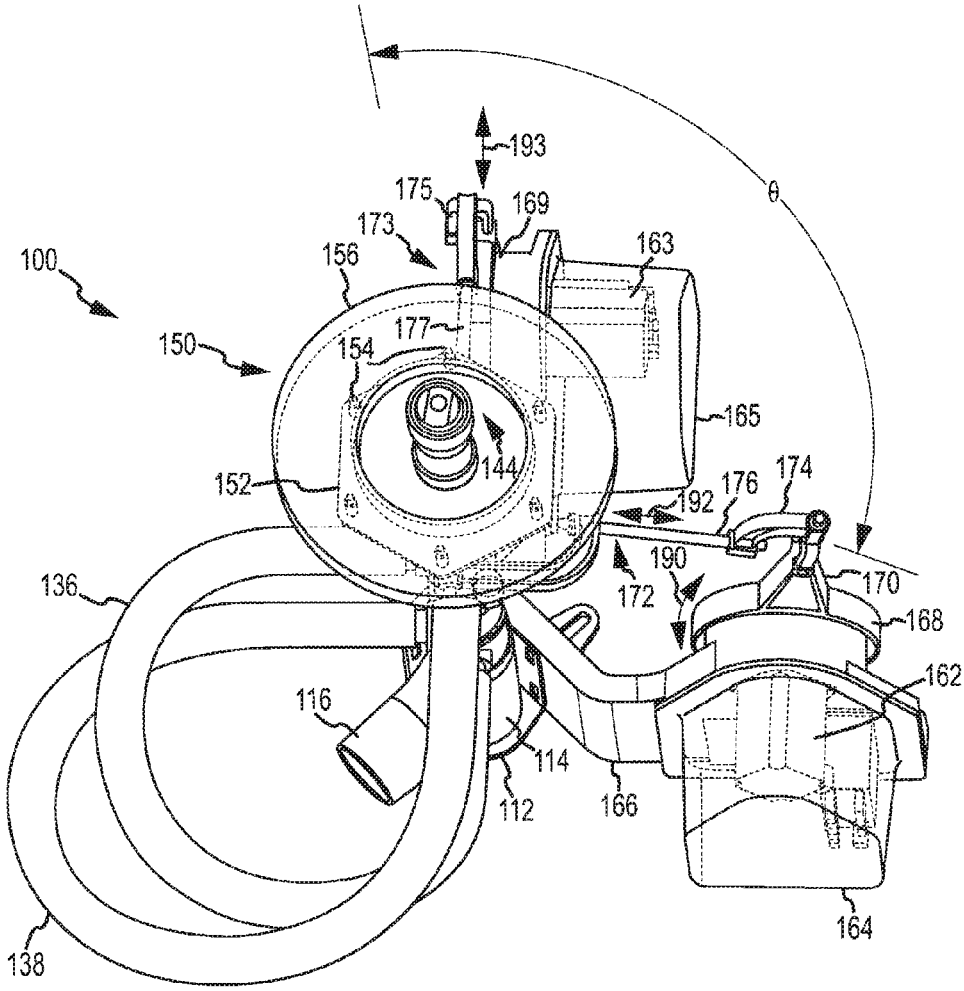
FIG. 2 is top view of the fluid effects platform of FIG. 1.
Figure 3:
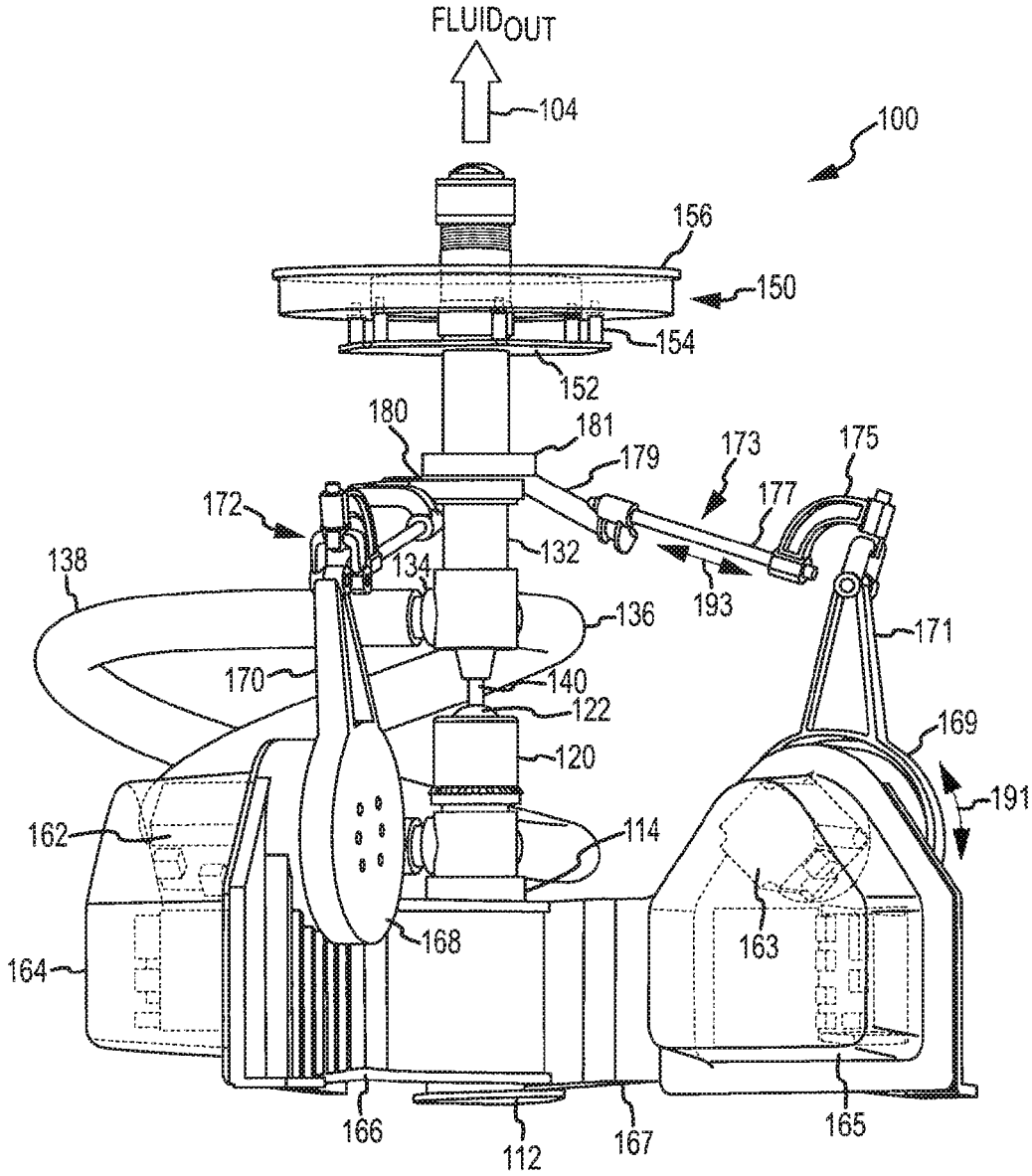
FIGS. 3 and 4 illustrate two additional side views of the fluid effects platform illustrating the use of a pair of drive arms offset by 120 degrees to position a pivotally mounted output or outlet manifold (e.g., a manifold including a nozzle or other outlet device)
Figure 4:
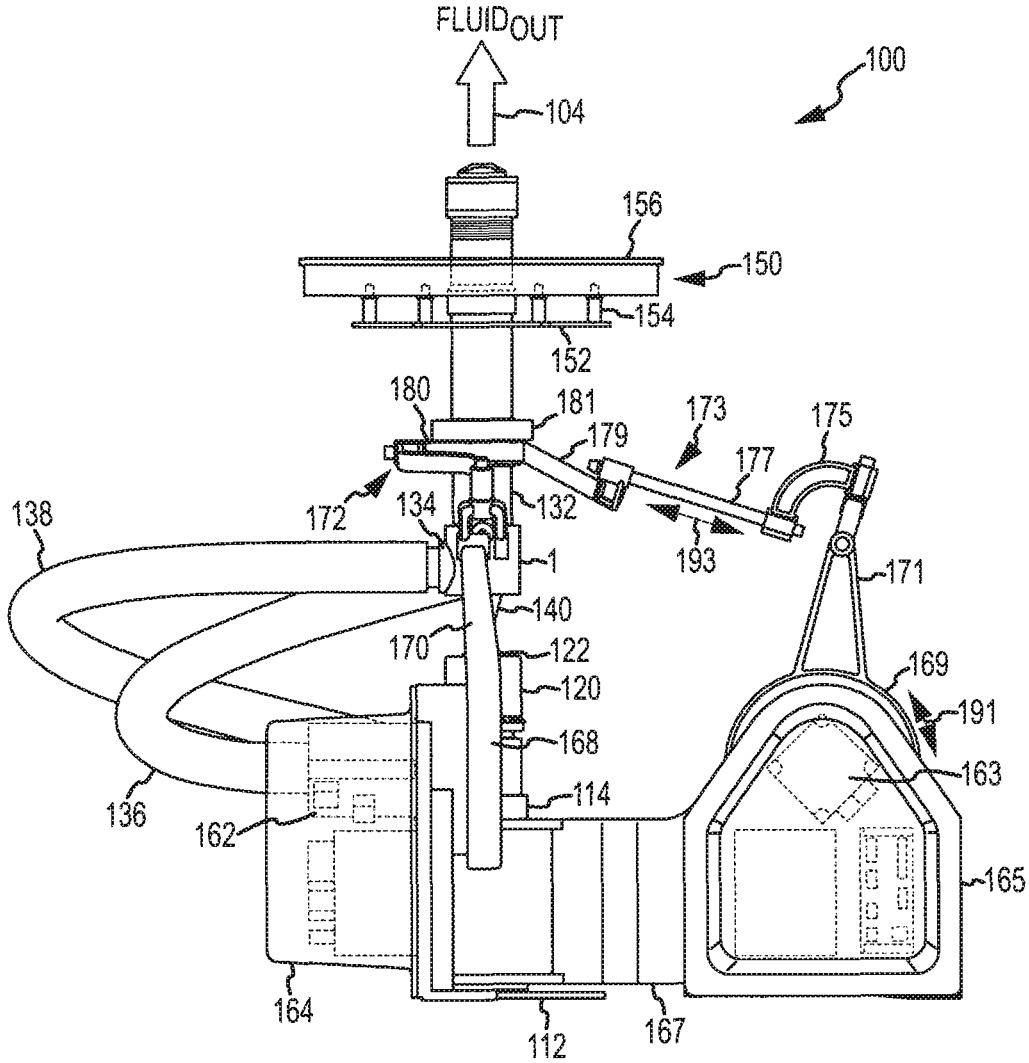

The push rods 172, 173 are each provided as double swing aims to provide relief from side loading of the push rods/pinions 172, 173. As shown in FIG. 2, the push rods 172, 173 generally extend outward from the body 132 of the outlet manifold 130 along a linear path and these paths are offset from each other by the offset angle, θ, which is typically about 120 degrees. As will be appreciated, the drive mechanisms 162, 163 may be separately or concurrently operated to cause the output plates 168, 169 to rotate 190, 191 in either direction and this causes the interconnected push/pull rod assemblies 172, 173 to move linearly 192, 193 to apply a pushing or pulling force to the body 132 at the collars 180, 181. By providing the proper control signals (e.g., based on a set of conical positions or the like) to the drives 162, 163, the body 132 may be pivoted about center point gimbal 122 to selectively and accurately position the nozzle 144.

The assembly 100 provides a compact unit that provides a significant improvement in size and weight. For example, the height and width of the assembly 100 may be less than about 3 feet as compared to water display devices in use that are 5 to 10 feet in height and width. Additionally, it is anticipated that the weight of the assembly 100 will be about 50 percent or less of existing devices while still being able to handle a payload (e.g., the outlet manifold 130, nozzle 144, and light ring 150) of up to 50 pounds or more. The manifolds 110, 130 and other structural components may be formed of a variety of materials useful for providing structural strength and, if appropriate, for containing pressurized fluids. The materials typically are also selected to suit the operating environment and conditions such as to resist corrosion when submerged within a body of water or other liquid and for containing a particular fluid such as water or a flammable fluid. In some embodiments, the manifolds 110, 130 are formed from a metal, a metal alloy, or the like while some applications may utilize plastics or other non-metallic materials.

Figure 5:
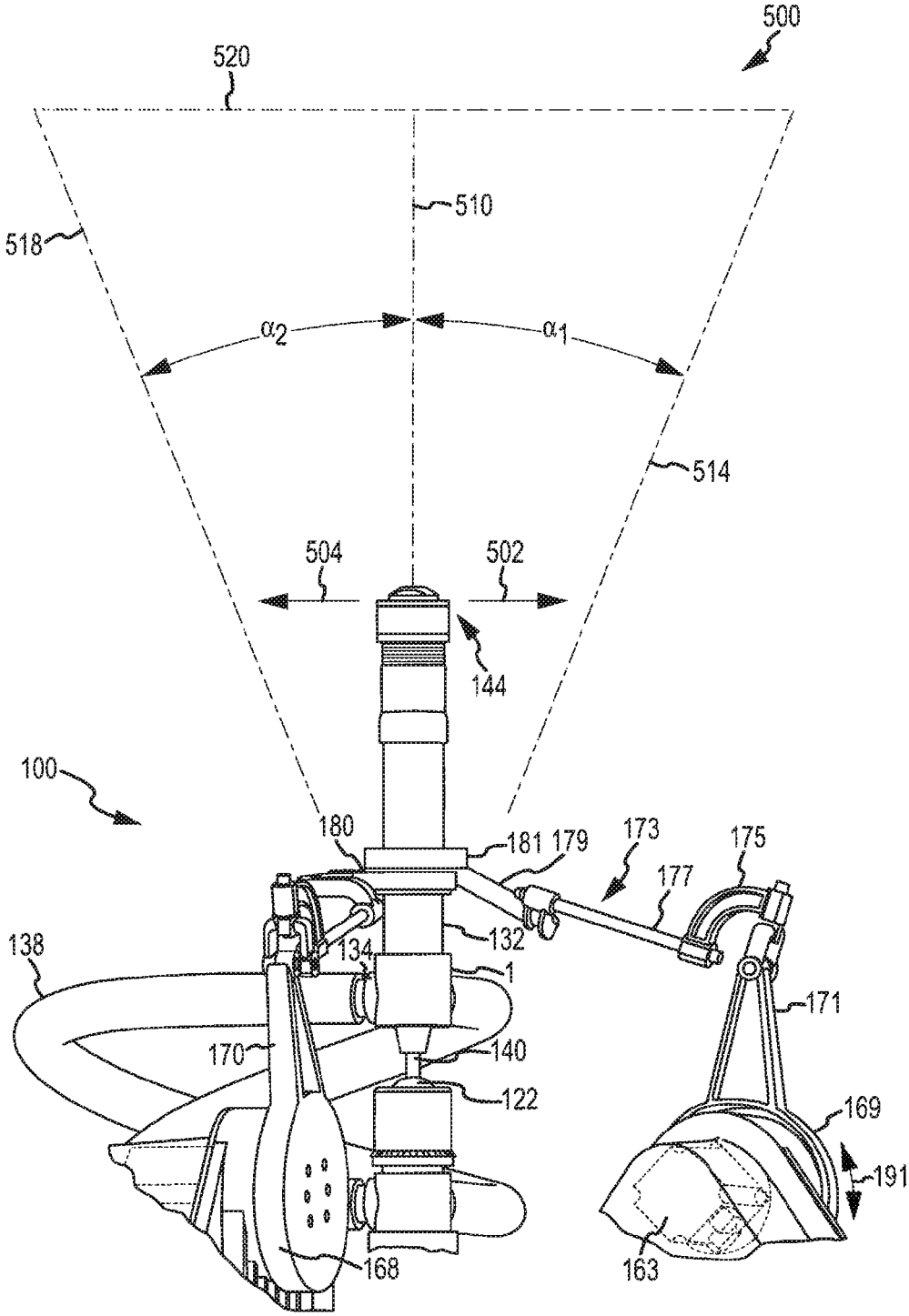
FIGS. 5 and 6 illustrate partial views of the fluid effects platform of FIGS. 1-4 with the cone that may be swept by movement of the output manifold (e.g., fluid nozzle may be thought of as having a conical degree of freedom) by operating the drive assembly to pivot the output manifold on the center point gimbal (e.g., ball joint, for example, or other joint that allows pivoting about a point, upon with the output manifold is mounted or interconnected)
Figure 6:
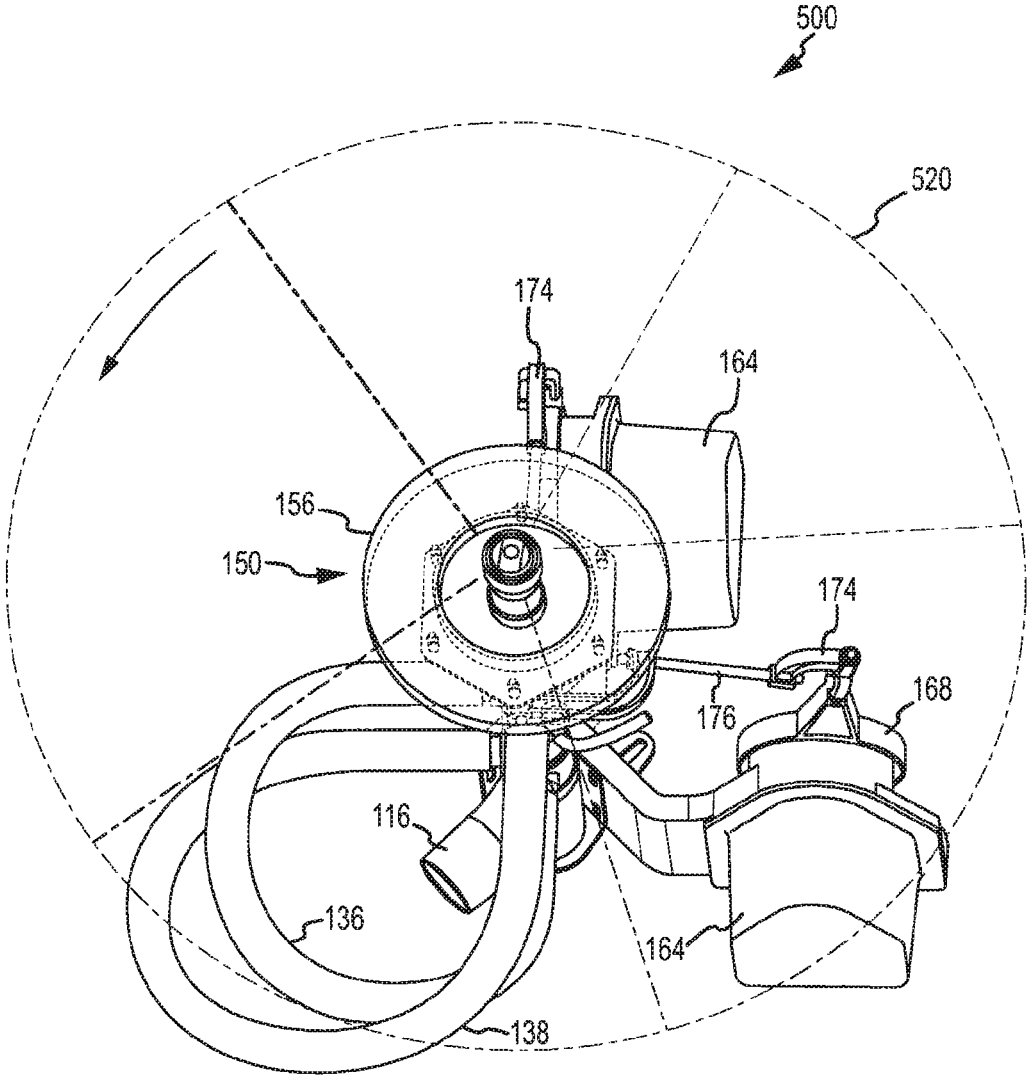

FIGS. 5 and 6 provide a partial view of assembly 100 showing the 3D space 500 in which the outlet manifold 130 may be positioned by operation of the drive assembly 160. As shown, the space 500 is generally an inverted cone or a frustoconical shape. Line 510 extends from the center of the body 132 and, in this case, nozzle 144, and it may coincide with the center axis of the outlet manifold 130 or body 132. The nozzle 144 may be moved by the drive assembly 160 in a first direction 502 (e.g., toward the right in FIG. 5) such as by applying a pulling force by one of push/pull rod assemblies 172, 173. As the nozzle 144 moves it traces or sweeps through an arc and may be moved to an outer limit shown at line 514 (i.e., the center axis of the body 132/nozzle 144 may now be located to coincide with line 514). The line 514 may be considered to be in or coincide with an edge or side of a cone 500, and line 514 may be a predefined angle from the center 510 as shown by angular offset, $\alpha_1$, that may in one embodiment be up to about 60 or more degrees with one embodiment setting the maximum angular offset or travel, $\alpha_1$, in any direction at less than about 55 degrees.

Likewise, the nozzle 144 may be moved in a second direction as shown at 504 (e.g., to the left in FIG. 5) by operation of the drive assembly 160 such as by applying a pushing force with one of the push/pull rod assemblies 172, 173. The nozzle 144 again traces an arc as the center axis of the body 132/nozzle 144 moves to a side or edge of the travel space/cone 500 as shown by line 518. This side of the cone 500 may be at an angular offset, $\alpha_2$, from the center 510, which typically matches the other angular offset, $\alpha_1$, such as by setting it at 55 degrees (which provides, in this example, a travel path of 110 degrees for the nozzle 140). Surface 520 is intended to represent a base of the cone 500 and shows that the nozzle 144/body 132 of the outlet manifold 130 may move in any direction (e.g., 360 degrees of freedom) from the center 510 (or home position of the nozzle 144/body 132). The assembly 100 may also be balanced or adapted such that its at rest position (e.g., with no additional force being applied by the motors 162, 163 or forces that act to balance the weight of the hoses 136, 138) is at or near center 510 such that the body 132 has its longitudinal axis substantially vertical.

The specific materials and other design characteristics such as many dimensions are generally non-limiting, but it may be useful to provide further design features of an embodiment of the assembly 100. Typically, the payload positioned above the swivel or ball joint 122 is less than about 30 pounds, such as less than 28 pounds for the light ring 150, nozzle 144, and the like, and the center of gravity of this payload may only be a preset distance/offset from the center of pivot ball 122 (e.g., less than about 2 feet such as less than 18-inch offset). Typically, the nozzle 144 will be relatively quickly positionable through its conical degree of freedom (e.g., its 110 degree or the like cone), such as a full in-plane stroke through vertical in less than about 2 seconds, and positioning accuracy (e.g., in pan and tilt) may be less than about 1 degree (e.g., with tilt commands referenced to plumb by a 2-axis inclinometer or the like and pan commands reference to machine base). The castings for the assembly may be stainless steel to provide corrosion resistance while some components (such as wings) may be aluminum or an alloy. The hoses may take a variety of forms but, in some embodiments, are 3-inch flex hose. The overall dimensions may be less than about 4 feet in height for the assembly 100, such as with the ball 122 being at about 2 feet from the base 112, and a width or diameter of less than about 3 feet.

While the nozzle 144 is shown to be a single nozzle, a nozzle assembly may be used in place. For example, it may be desirable to use 2 or more nozzles that are operable concurrently or separately to achieve a desired fountain or display effect. One or both of the nozzles in a dual or multi-nozzle assembly replacing or supplementing nozzle 144 may be air-operated, push/pull valve nozzles or other useful fountain nozzle designs. The nozzles in such an assembly may be targeted in a single direction or multiple directions, and the relationship or relative orientation between the nozzles may be fixed or variable during operation of the assembly 100. A manifold may be provided above or, more typically, below the light ring 150 to supply water/fluid to the nozzles from the hoses 136, 138. The nozzles often will be of differing design to achieve 2 or more effects, and the outlets of the nozzles typically (but not necessarily) will be spaced apart, such as with an offset or spacing of 4 to 8 inches. In some embodiments, the sealed housings (or drive housings) 164, 165 are specially adapted for submerging underneath fluid levels (e.g., up to 6 to 10 feet or more), while maintaining a leak proof/resistant seal. This allows the controls to be submerged and simplifies wiring of the unit 100. The drive in the housings 164, 165 may include a control card, servo drivers, potted connections boxes, heat sinks, and the like, with AC power being supplied via an external connection (e.g., 208 VAC 60 Hz, 3-phase, 10 amp or the like).

The fluid effects assembly 100 of FIGS. 1-6 may be used in a fluid (e.g., water) display or show system 700 as shown in FIG. 7. The system 700 is shown with a single assembly 100, but it should be understood that the system 700 may readily be adapted to include numerous assemblies 100 and the operation of this larger set of assemblies 100 may be synchronized to create a display or show along with the raising and lowering of the assemblies 100 on platforms/frames 770.

To this end, the system includes a computer system 710 that functions as a controller for the system 700 that may be operated to automatically or in response to operator input remotely control the fluid effect assembly 100 including positioning of the nozzle 144 within its conical travel envelope and selectively dispersing fluid 104 from the nozzle 144. The computer system 710 includes a processor 712 for running a show control program (not shown but that may be provided in computer-readable medium accessible by processor 712 such as in memory 718) that is adapted to control operation of the assembly 100 and other components of system 700, and the program may generate a GUI 715 on a monitor 714 to allow an operator to enter control commands for the assembly 100, to initiate a set of show commands 719, and/or to adjust operating parameters for the system 700. The processor 712 also manages memory 718 and stores show commands 719 in memory 718 including conical positions 720 of the nozzle 144 (or the body 132 of the outlet manifold 130). In one embodiment, a reverse kinematics algorithm is used to convert input/show commands that are provided in pan/tilt form to conical positions 720 that may be used to selectively drive the push/pull rod assemblies 172, 173 with drive mechanisms 162, 163. The control by computer system 710 may include operating electrical supply 730 to provide power to one or both of the drive mechanisms 162, 163 of fluid effects assembly 100 or may be via wireless signals (e.g., remote operation of DC servo motors with a battery or power source provided in housings 164, 165 of assembly 100).

In one embodiment, an inclinometer is provided such as on the body 132, the nozzle 144, or another useful location/position in or near assembly 100, and the inclinometer transmits signals to the control system 710 for processing by homing module 716. For example, it may desirable for the system 700 to be adapted such that the horning module 716 is periodically run automatically, as part of a pre-show routine in show commands 719, or in response to an operator entering a "home" selection or the like in GUI 715 or by other methods. The homing module 716 works with the inclinometer to automatically determine the present inclination of the body 132 and/or nozzle 144 in respect to gravity (e.g., the position of the longitudinal axis of the body 132 relative to vertical). Specifically, the horning module 716 may query the inclinometer on the assembly 100 and determine the present inclination or tilt, and then operate the drive mechanisms 162, 163 to reset the nozzle 144 at zero inclination in respect to gravity (e.g., by determining a new conical position and necessary movements of the drive mechanisms 162, 163 to achieve this position and a second determination of inclination may be performed after initial reset to assure that zero inclination is achieved). In other embodiments, "home" may not be zero inclination, and the inclinometer and homing module 716 may be used to reset the nozzle 144 to this alternative home or offset from vertical.

Water display system 700 may be thought of as being made up of computer system 710, auxiliary services 730, lift linkage assembly 740, pump 780 and fluid effects assembly 100. Computer system 710 operates to control the supply of auxiliary services 730 to the remainder of water display system 700. In the embodiment shown, the remainder of water display system 700 makes use of electrical supply 732 and air supply 734, each having communications links 722 from computer 710. Other services such as fuel (for inclusion of flame in the water display), fire color agents, igniters, light beam coloring wheels, and the like may be included in the auxiliary services 730 and/or on platform 770 or as part of the payload of assembly 100. Communication links 722 may be a direct link through cabling or an indirect link through known methods.

The particular support assembly used along with the lifting assembly 740 may be varied to practice the invention. The assembly 740 Shown is shown in U.S. Pat. No. 6,131,810, which is incorporated herein by reference, but other systems and structures may be used to vertically position the assembly 100 relative to a surface of a body of water 702. For example, an assembly similar to that shown in U.S. Pat. No. 6,053,423, which is incorporated herein by reference for all its teaching on supporting and selectively positioning water display devices, may be used in the system 700.

Air supply 734 may be used to supply the force to position platform 770 supporting assembly 100 in two or more vertical positions including an operative or performance position (as shown in FIG. 7), a service position (which may place the platform 770 at, near, or above the surface of the water 702), and the non-operative or non-show position (which typically would place the nozzle 144 lower than shown in FIG. 7 such as fully below the surface of water 702). The lifting/lowering force may be first transmitted to linkage assembly 740 through fluid lines 736 and then converted into motion by linkage assembly 740. By transmitting this controlled motion to platform 770 and assembly 100 through linkage assembly 740, the assembly 100 may be positioned into one of its two or more vertical positions.

As shown in FIG. 7, linkage assembly 740 may be a system of interconnected machine elements, such as cylinders, pistons, pivots, and yokes, used to transmit motion to assembly 100. Linkage assembly 740 may include cylinder 742, piston 744, cylinder 746, piston 748, pin 750, positioning yoke 752, platform link 754, pins 756, fulcrum 758, frame 760, base 764, bolts 766, support frame 770, stabilizing yoke 772, pins 774, and pin 776. Air supply 734 may be connected to both cylinder 742 and cylinder 746 of linkage assembly 740 through the appropriate number of fluid lines, schematically represented by fluid lines 736. To move positioning yoke 752, each cylinder has a piston that may be responsive to air from air supply 734. Piston 744 operates with cylinder 742 and piston 748 operates with cylinder 746. Piston 744 is shown in FIG. 7 under fluid pressure from air supply 734 so as to raise platform 770 and assembly 100 to the performance or show position. Piston 748 is shown in FIG. 7 not under fluid pressure from air supply 734, thus maintaining assembly 100 in the performance position. The supply from air supply 734 may be any service that imparts force to move piston 744 and piston 748, such as air or water. Of course other types of actuators and/or linkages may be used for this purpose as desired. To transmit the vertical motion of piston 748 and piston 744 to assembly 100, piston 748 may be coupled to positioning yoke 752 through pin 750. In turn, positioning yoke 752 may be coupled to assembly platform 770 through platform link 754 at pins 756. To permit raising the assembly 100 in response to lowering one or both of piston 744 and piston 748, positioning yoke 752 may be coupled to fulcrum 758.

Frame 760 provides support for fulcrum 758. Base 764 serves as a stable platform on which frame 760, cylinder 742, and pump 780 may be attached. Base 764 may be fixed to a pool bottom or other structure 790 through, for example, bolts 766. For added control to water display 700, base 764 may be placed upon a computer controlled, motor driven wheeled platform on rails, that serves as a stable platform on which frame 760, performance cylinder 742, and pump 780 may be attached. Support platform 770 is supported by platform link 754 at pins 756 and 774 and serves as a raised platform on which performances or discharges of water or fluid stream 104 are presented based on show commands 719 for example. With pin 776 fixed to frame 760 at a point vertically below fulcrum 758, stabilizing yoke 772 rotates about pin 776 as positioning yoke 752 rotates about fulcrum 758 so as to maintain the known orientation of platform link 754, and thereby maintain the known orientation of support frame or platform 770.

As seen in FIG. 7, pump 780 may be coupled to assembly 100 through flexible hose 782. In some embodiments, pump 780 may be a variable frequency pump so that the velocity and/or pressure of the water flow through nozzle 144 may be controlled by computer 720 through the power supplied from electrical supply 732 to pump 780. Pump 780 is Shown in FIG. 7 as a submersible pump residing in a low-lying place within water 702 and attached to base 764. This may be preferable since residing in a low-lying place within water 792 permits pump 780 to be positioned close to the water display and to directly draw from and be cooled by water 792. In small-scale installations, pump 780 may conveniently be placed in a dry room near electrical supply 732 and air supply 734 and use the water 702 as a source or use a different water or fluid source.

The fluid effects assembly (e.g., a water fountain or display device) 100 is believed well suited for many applications as it provides a compact unit that provides accurate positioning of a nozzle. However, it is understood by the inventors that there may be other embodiments of fluid effect devices that will be apparent once the device 100 and its functionality is understood. For example, the device 100 is shown with 2 drives with positioning force input members (rod assemblies 172, 173) that operate along opposing axes that are offset by an angle such as 120 degrees. In other embodiments making use of a pivotally-mounted outlet manifold, additional input members may be provided such as by moving the hoses 136, 138 and providing a third input member and drive mechanism offset by 120 degrees or other offset from the assemblies 172, 173. In other cases, the device 100 may be modified by altering the hose arrangement such as by providing only one hose from the inlet manifold to the outlet manifold or more than 2 (such as 4 looped or bowed hoses) Alternatively, a single inlet hose or line may be used to provide the fluid directly to the outlet manifold with the inlet manifold functioning as a support frame or structure for the center point gimbal (e.g., for providing the ball joint 122) and the attached outlet manifold 130.

Figure 8:
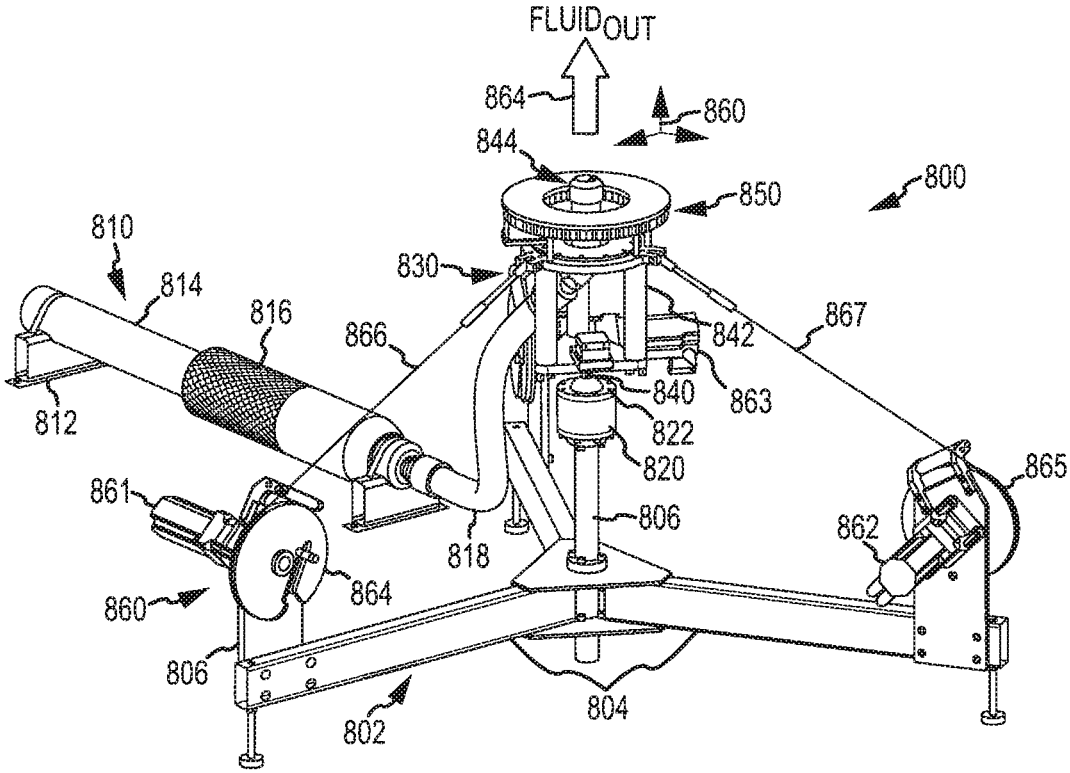
FIGS. 8 and 9 show a perspective and side view of a fluid effects platform or stage of an embodiment of the invention, which may also be labeled a water display device of another embodiment of the invention using three drive arms (e.g., tensioned cables) to selectively position a pivotally mounted outlet manifold with attached nozzle or fluid outlet.
Figure 9:
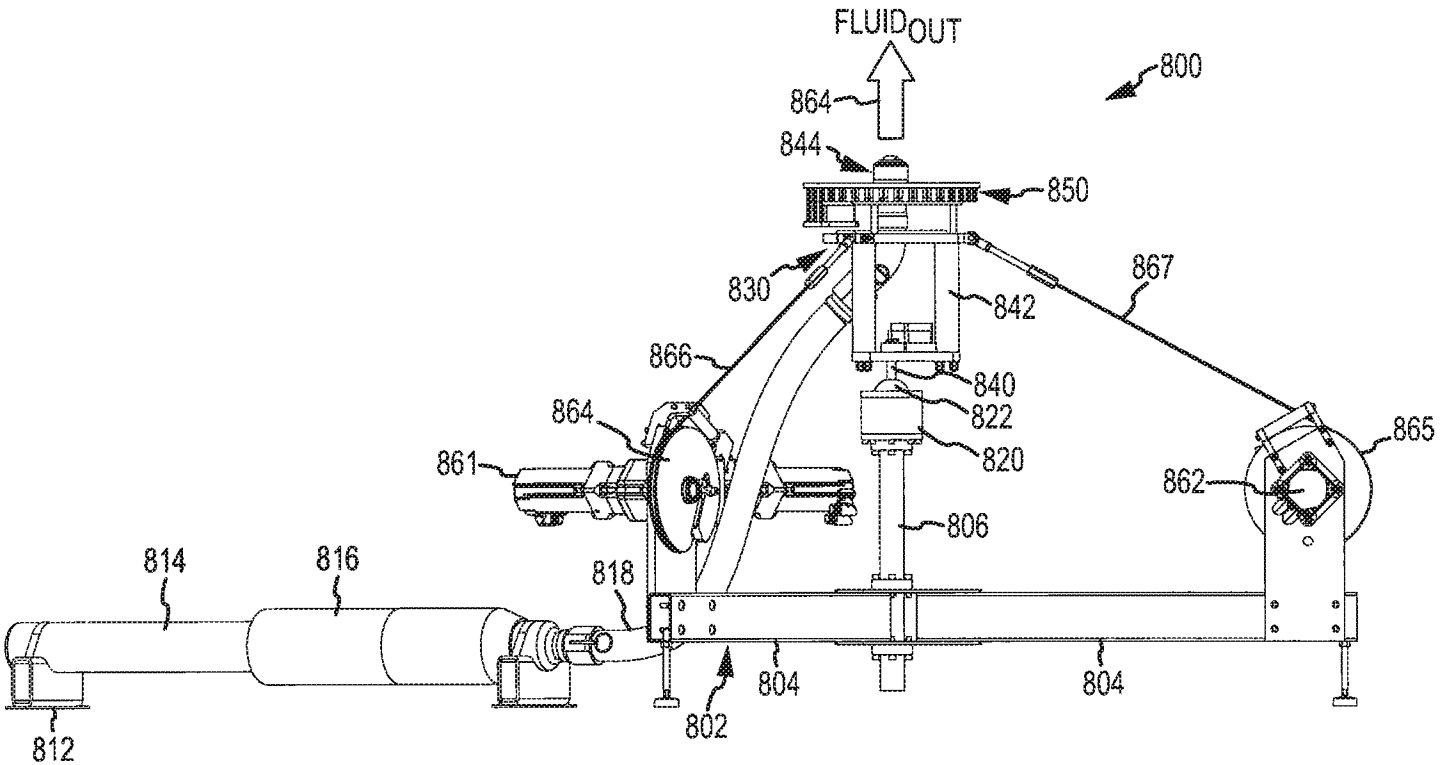

At this point, it may be useful to illustrate another fluid effects assembly 800 with reference to FIGS. 8 and 9 so as to expand on the idea that the outlet manifold, fluid inlet, drive or positioning system, and other components of a fluid effects assembly may be varied from what is shown in FIGS. 1-7 while still utilizing the pivotal mounting of the outlet manifold to position a nozzle and/or other payload. As shown, the assembly 800 includes a support assembly 802 rather than an inlet manifold as shown in assembly 100. The support assembly 802 includes legs or frame members 804, and the frame members 804 include mounting plates 806 for supporting portions of the drive or positioning assembly 860. The frame members 804 are also used to support a centrally positioned rod or shaft 806. A receiver or support 820 is provided on top of central rod 806 and a center point gimbal such as a ball joint 822 is positioned within the receiver 820 such that the gimbal 822 freely pivots and/or rotates.

The assembly 800 includes an outlet manifold or assembly 830 that is supported upon the gimbal or pivotal joint 822. In this case, the manifold 830 includes a frame 842, which is rigidly connected via rod or pivot pin 840 to the gimbal 822 such that the gimbal 822 moves with frame 840 as shown with arrows 860 (e.g., in multiple directions relative to a center axis or "home" position). The manifold or assembly 830 includes a nozzle 844 through which fluid 864 is discharged to create a fluid (e.g., water) display when the assembly 800 is operated. To provide fluid to the nozzle 844, the assembly 800 includes a fluid supply assembly 810, which includes a pump support 812 that may be attached to a positional frame/platform (e.g., frame 770 of FIG. 7 or the like) or to a basin of a body of water. The fluid supply assembly 810 includes a submersible pump (e.g., a 15 HP pump or the like) 814 that draws fluid from the surrounding body of water in which the assembly 800 is placed. A strainer 816 may be provided at the pump outlet to reduce risk of clogging nozzle 844. A hose or line 818 is coupled to the outlet of strainer 816 (or directly to pump 814) at a first end and to an inlet to the nozzle 844 (or to a body of manifold 830 if one is provided for receiving the nozzle 844). The hose 818 is made of flexible material and is arranged with slack to allow it to move with the outlet manifold or assembly 830 during operation of the assembly 800 to position nozzle 844.

A drive or positioning system 860 is provided in the assembly 800 to control or adjust the position of the nozzle 844 relative to vertical (or other home position). As with the assembly 100, the nozzle 844 may be articulated in an arc of up to about 120 degrees with some embodiments allowing 55 degrees of movement in any direction from center (e.g., from an axis extending through the rod 806, through pin 840, and nozzle 844). In contrast to assembly 100, the positioning system 860 includes three drive mechanisms 861, 862, 863 (e.g., submersible servos or the like) that are mounted upon mounting plates 806 and are each operated (separately or concurrently) to rotate three attached cable spools 864, 864. A cable or wire 866, 867 is attached to the spool 864, 865 of the drives 861, 862, 863 at one end and to the outlet manifold or assembly 830 at frame 842. The cables (or positioning force input members) 866, 867 are arranged in assembly 800 such that they are offset from each other by 120 degrees. During operation, the cables 866, 867 are typically under tension to hold the nozzle 844 in a vertical position and the amount of tension is increased or decreased to apply a pulling force on the frame 842, and by operating the drives 861, 862, 863 the tension (or applied force) can be adjusted to cause the frame 842 and attached nozzle 844 to move through a conical space (e.g., see FIGS. 5 and 6).

Figures 10A, 10B, 10C:
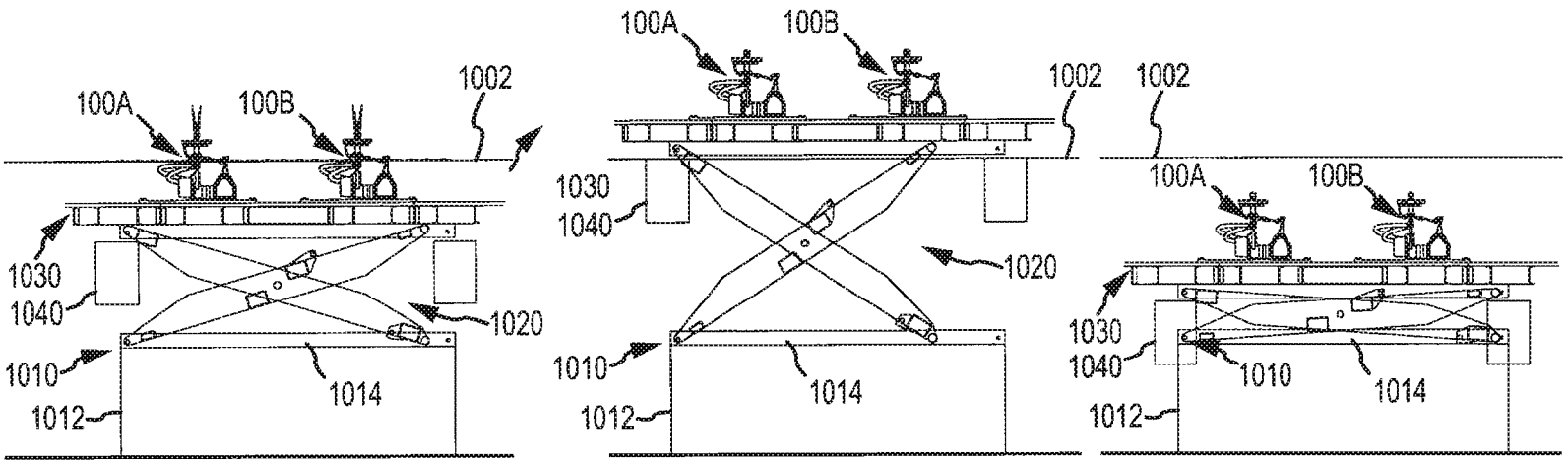
FIGS. 10A-10C illustrate a side view of water display or fountain system that may be used in accordance with an embodiment of the invention (with remote control/operation components not shown for ease of illustration but may include those discussed with reference to FIG. 7 or the like)

As discussed with reference to FIG. 7, the fluid effects assembly 100 of FIG. 1-6 (and other embodiments as shown in FIGS. 8 and 9) may be used in fluid or water displays such as shown in FIG. 7. FIGS. 10A-10C illustrate another show system in which two or more fluid effects assemblies 100A and 100B are selectively positioned relative the surface of a body of water 1002. FIG. 10A illustrates a pair of assemblies 100A, 100B positioned in a show position via fountain positioning assembly 1010. The positioning assembly 1010 includes a base structure 1012 that may be rigidly mounted to the bottom of a lagoon or other man-made or natural reservoir or holding volume for fluid/water 1002. On an upper surface 1014 of the base structure 1012, a linkage assembly 1020 is provided that interconnects the base structure 1012 and a show/mounting table 1030. The effects assemblies 100A, 100B are rigidly attached to an upper surface of the table 1030, and are positioned relative to the surface of fluid/water 1002 via movement of the table 1030.

To this end, the fountain positioning assembly 1010 includes a ballast assembly 1040 (e.g., two or more air/water ballast tanks), which functions to move the table 1030 and attached effects assemblies 100A, 100B from the show position in FIG. 10A to a raised maintenance position shown in FIG. 10B and to a lowered storage position shown in FIG. 10C. In operation, the air/water ballast tanks 1040 do the lifting in the fluid/water 1002 of the table 1030, and remote controls for operating the tanks 1040 and/or the effects assemblies 100A, 100B are not shown, but may take the form as described with reference to FIG. 7 or the like. The linkage assembly 1020 may take on a scissor configuration as shown, and, in some cases, is used for lateral support and/or to fix/lock the height of the table 1030 in the show position of FIG. 10A and the maintenance position of FIG. 10B. The height of the table 1030 and attached/supported fountain assemblies 100A, 100B is maintained relative to the surface of fluid/water 1002 via the ballast system 1040. The height is independent of the level of the lagoon depth from the bottom. When the table 1030 is all the way down in the storage mode as shown in FIG. 10C, the table 1030 and/or the linkage assembly 1020 sits or rests upon the upper surface 1014 of the base or support structure 1012 above the bottom of the lagoon/reservoir/structure containing the fluid/water 1002.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, specific operating parameters may be varied widely to use the fluid effects assemblies of the invention such as varying fluid flow rates and pressures. Likewise, the forces that the cables and rods apply to the outlet manifold (and the corresponding strength of these components to provide these forces/inputs) will typically depend upon the size and weight of a particular outlet manifold, the fluid inlet hosing, fluid pressures, and other parameters, and the invention is not limited to particular configurations of these positioning member/elements (e.g., the push/pull rods 172, 173 of FIGS. 1-4 and positioning cables 866, 867 of FIGS. 8 and 9).

As discussed above, there are some applications where it is desirable to provide two or more nozzles in a fluid effects platform. For example, it may be desirable to be able to change a display by changing from a first nozzle that provides one water display effect (e.g., a fountain with a plurality of jets or the like) to a second nozzle that provides a second, differing water display effect (e.g., a sheet or wall of water or the like). Additionally, it is preferable that the selection of which nozzle or outlet is used to discharge fluid from the platform be remotely selectable or that switching between nozzles be remotely controlled such as by the control or computer system 710 shown in the water display system of FIG. 7. Such remote switching typically would be synchronized with other effects such as light displays and audio of a show/display. Additionally, it is generally desirable that the two or more nozzles and their controls be provided to not (or to a limited amount) effect the overall dynamics and weight balance of the fluid effects platform such that the benefits discussed above with the drive assembly and placement of the fluid tubing/hoses is retained in the platform.

Figure 11:
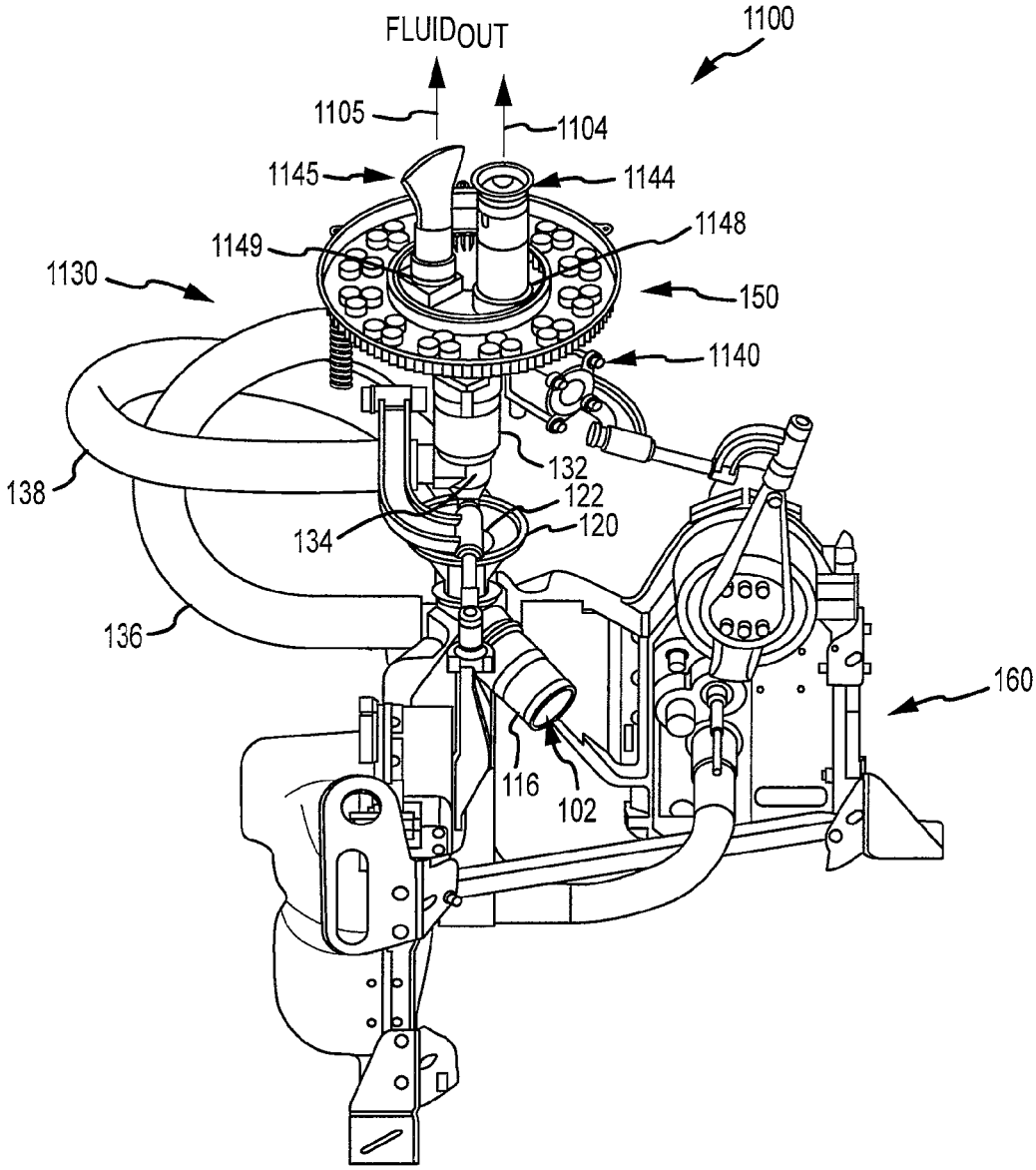
FIG. 11 illustrates a dual nozzle embodiment of a fluid effects platform that includes a fluid outlet manifold with a nozzle manifold configured for remote switching of the outlet fluid flow between two nozzles or fluid outlets.

FIG. 11 illustrates a dual nozzle embodiment of a fluid effects platform 1100 that includes a fluid outlet manifold 1130 with a nozzle manifold 1140 configured for remote switching of the outlet fluid flow 1104, 1105 between two nozzles or fluid outlets 1144, 1145. The fluid effects platform 1100 may be thought of as being a modified version of the platform 100 in which the fluid outlet manifold 130 is replaced with fluid outlet manifold 1130 with its two nozzles 1144, 1145.

Hence, a number of components found in platform 100 and described above are also included in platform 1100, and these components are labeled with like numbers and not described in detail again (as the prior description remains relevant for platform 1100). For example, the platform 1100 includes a drive assembly 160 that is used to selectively pivot the fluid outlet manifold 1130 on a center point gimbal 122 on support 120, with fluid hoses 136, 138 offset from the drive arms 172, 173. The hoses 136, 138 provide the inlet fluid 102 to inlets 134 of the body 132 of the fluid outlet manifold 1130 (with the body 132 connected by a connector or rod to the center point gimbal 122).

As shown in FIG. 11, the fluid outlet manifold 1130 includes a nozzle manifold 1140 that is mounted on the body 132 on an end opposite to the connector/rod and center point gimbal 122. The nozzle manifold 1140 is configured to receive the inlet fluid 102 flowing through hoses 136, 138 from an outlet of the body 132, and the nozzle manifold 1140 is generally positioned with its center (and center of gravity) along the center axis of the body 132 to generally distribute its mass in a manner that limits eccentric loading within the platform 1100 and push/pull driving with drive assembly 160. The fluid outlet manifold 1130 includes a light ring assembly 150 that is mounted on the nozzle manifold 1140 (e.g., opposite the fluid inlet and connection to body 132). As a result, the nozzle manifold 1140 and light ring assembly 150 are structurally supported by body 132 in platform 1100 and also move as a unit as the body is pivoted on center point gimbal 122 by the drive assembly 160.

The nozzle manifold 1140 includes first and second fluid outlets 1148, 1149 through which outlet fluid 1104, 1105, respectively, may be selectively discharged by operation of the remotely switchable nozzle manifold 1140. The first and second nozzles 1144 and 1145 are attached to (in fluid communication with) these outlets 1148, 1149. As discussed above, the configuration of these nozzles 1144, 1145 may vary widely to practice the platform 1100 and is not considered limiting to the invention with the important aspects being the inclusion of two or more nozzles upon the fluid outlet manifold 1140 and that which nozzle 1144 or 1145 that discharges fluid 1104, 1105 is remotely switchable/selectable by a controller. In the embodiment of platform 1100, the two nozzles 1144, 1145 extend through the center of the light ring assembly 150, which allows the platform to be compact and retains the discharge outlet near the center axis of the platform 1100. However, other designs may call for the nozzles 1144, 1145 to extend in differing ways from the manifold 1140 such as one within the center of ring assembly 150 and one or more about the periphery of the ring assembly 150.

Figure 12:
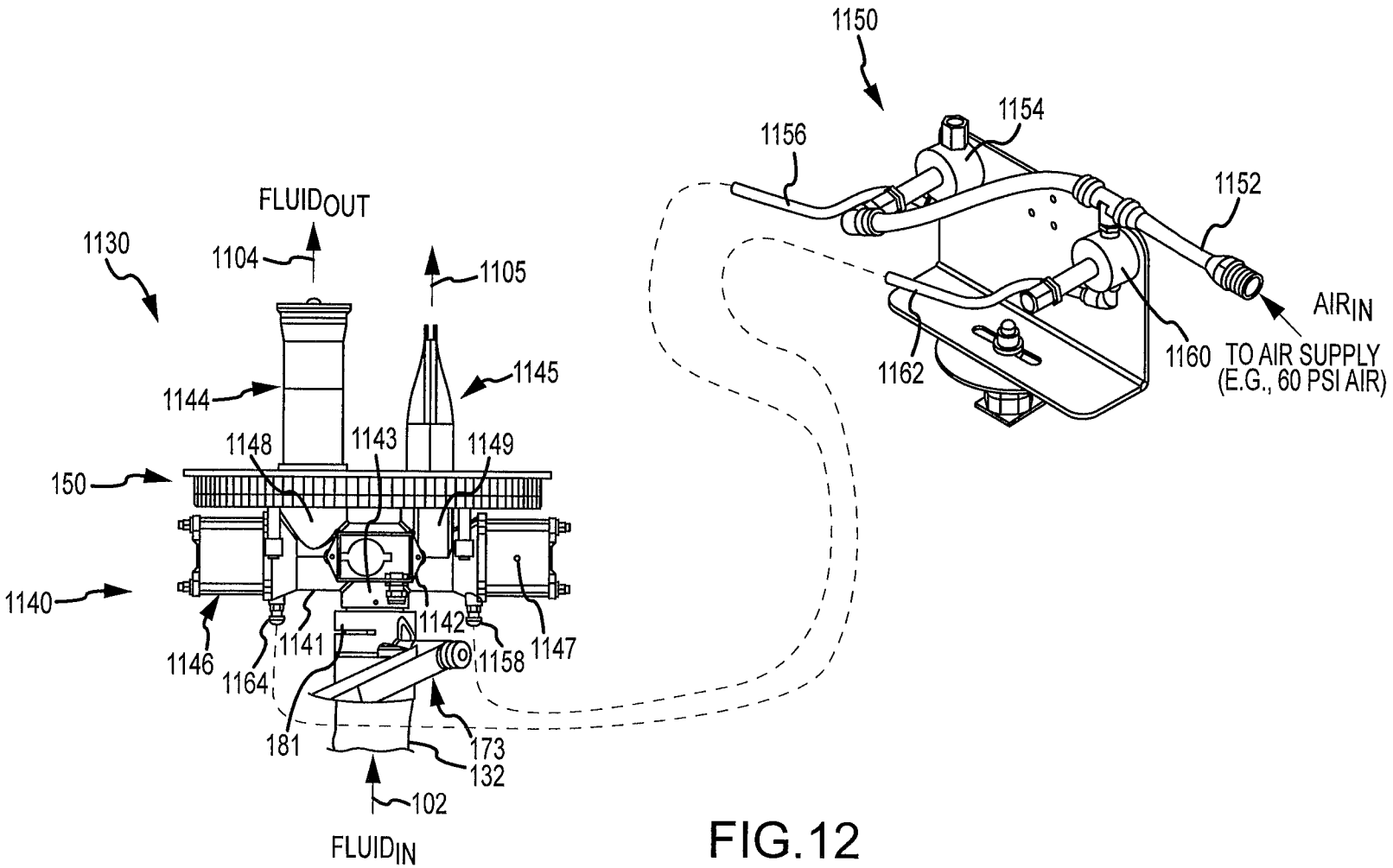
FIG. 12 illustrates the fluid outlet manifold assembly in more detail showing the nozzle manifold along with a portion of the nozzle selection assembly (or nozzle control assembly)

FIG. 12 illustrates the fluid outlet manifold 1130 in more detail including details of the nozzle manifold 1140 along with a portion of the nozzle selection assembly (or nozzle control assembly) 1150, which is used to remotely switch between or select which of the nozzles 1144, 1145 is active in the platform 1100. As shown, the nozzle manifold 1140 includes a body 1141 (e.g., a tubular body with fluid flow channels (not shown) for allowing fluid to flow to nozzles 1144, 1145) that is attached to the body 132 at fluid inlet 1143, which receives inlet fluid 102 flowing through body 132. The body 1141 houses a diverter or valve 1142 that is operable to direct flow of the inlet fluid 102 to a first fluid outlet 1148 or to a second fluid outlet 1149. The first nozzle 1144 is fluidically coupled to the first outlet 1148 and the second nozzle 1145 is coupled to the second fluid outlet 1149 such that operation of the diverter/valve 1142 causes either fluid output stream 1104 via nozzle 1144 or stream 1105 via nozzle 1145 to be provided by platform 1100.

The nozzle manifold 1140 with its switching valve/diverter 1142 may be remotely operable by nozzle control assembly 1150. In the illustrated embodiment, the nozzle manifold is air actuated or operated. Specifically, the manifold 1140 includes a first air switch 1146 and a second air switch 1147 in the body 1141, and an air inlet 1164, 1158 is provided for each of these switches 1146, 1147 such that when pressurized air is provided to either of the switches 1146, 1147 the valve/diverter 1142 is operated to switch or divert the fluid flow in body 1141 to either first nozzle 1144 or to second nozzle 1145, respectively.

Further, in this regard, the fluid outlet manifold 1130 includes the nozzle control assembly 1150 that includes an air intake line or manifold 1152 that is linked to an air supply (not shown in FIG. 12 but may be supply 734 in system of FIG. 7). In this way, the intake line 1152 is filled with pressurized air (e.g., 30 to 60 or higher PSI air) that may be used to operate the nozzle manifold 1140 to select an active nozzle 1144, 1145. The control assembly 1150 includes a pair of control valves 1154, 1160 that may be remotely operated or triggered (e.g., solenoid valves responsive to control signals from a display control system) to cause the pressurized air in line 1152 to be fed to switches 1146, 1147. Air lines or control lines 1156, 1162 are provided at the outlets of the control valves 1154, 1160 to provide a path for the pressurized air to pass to the nozzle switch air inlets 1158 and 1164. Note, in this embodiment, the nozzle control assembly 1150 is mounted apart from the fluid outlet manifold 1130 or off-platform to reduce the weight that has to be supported on body 132 and nozzle manifold 1140, but some embodiments may position the assembly 1150 on the manifold 1140 or otherwise to be supported by body 132. During operation, an controller or control system (such as system 710 of FIG. 7) operates to transmit signals to the control valves 1154, 1160 so as to switch back and forth between the nozzles 1144, 1145 by operating switches 1146, 1147, which switches between outlet fluid flows 1104, 1105.

In addition to selecting or switching nozzles, the inventors recognized that it may be useful for some embodiments of the fluids effect platform to provide a rotatable or twisting nozzle to create a fluid display not possible with a nozzle that is still on the pivoting platform. In other words, some fountain-like effects are possible when one or more the nozzles on the fluid effects platform is rotated such as about its central axis. For example, the "twisty" nozzle may have one or more outlets that discharge outlet fluid outward at an angle from the center or rotation axis, and rotation of the nozzle through a full 360-degree rotation (or some portion of such a full rotation) creates a moving wall or series of jets of water about the fluid effects platform.

The rotating or twisting nozzle may be also be pivoted on the center point gimbal along with the fluid outlet manifold so as to allow accurate positioning of its discharged or outlet fluid. A display control systems such as system 710 of FIG. 7 may be used to synchronize the rotation and twisting of the rotatable nozzle to synchronize its movement with a show and/or with other fluid display platforms (e.g., tens to hundreds of the platforms may provide a carefully synchronized show within a lagoon or the like). For example, the twisting of the nozzle may be provided by use of a servo motor or other driver an absolute encoder in this driver may provide an accurate and trackable positioning of the nozzle about the central/rotation axis (e.g., rotation to 0.5 to 1 degree tolerance margin via proper indexing) such that the specific axial location of the twisty nozzle may be known by the control system at all times during a display or show and the nozzles may be reset to known park or between displays position with accurate alignment (e.g., return to a "zero" setting at the end of a choreographed show).

Figure 13:
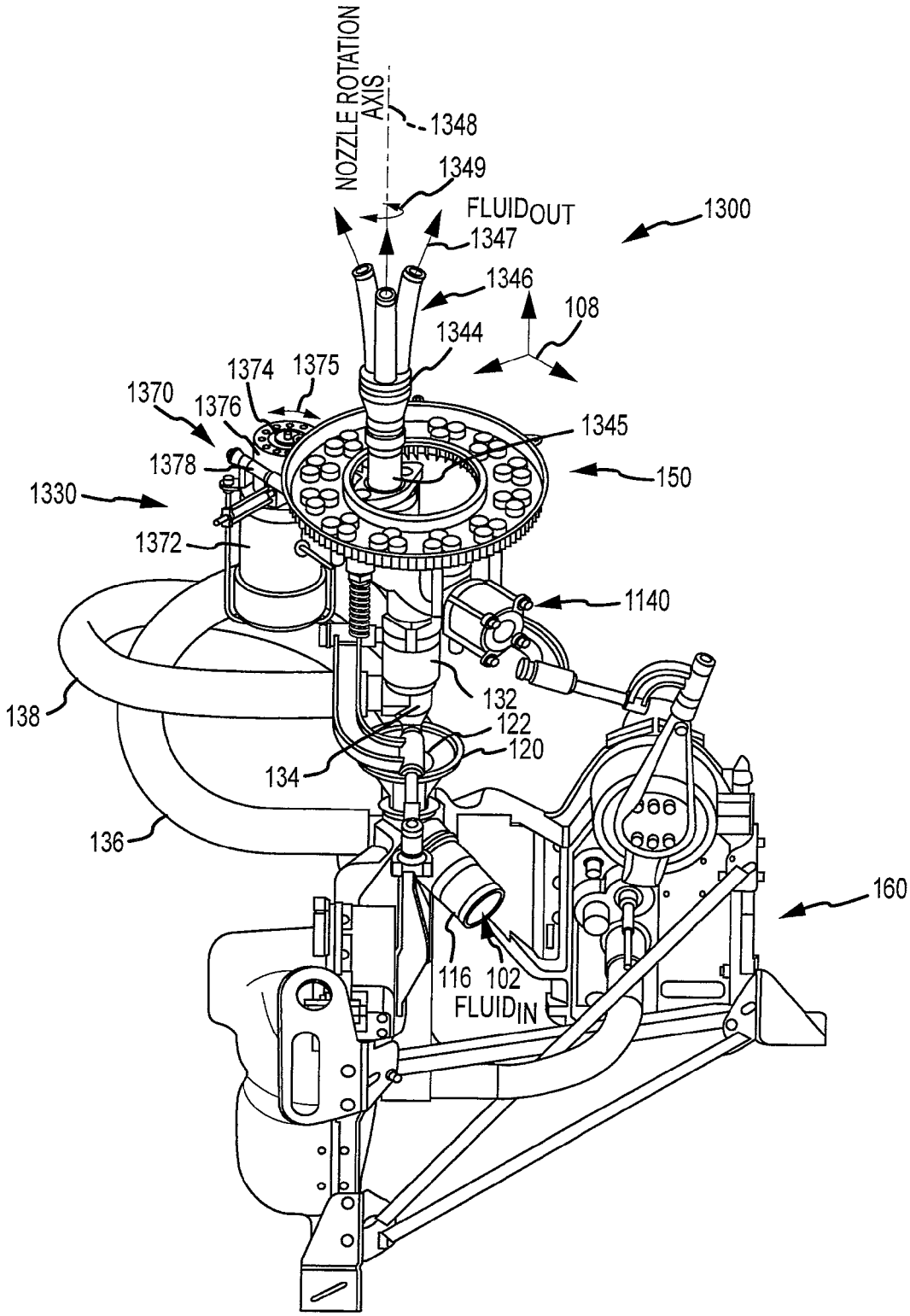
FIG. 13 illustrates a top perspective view of a fluid effects platform with a fluid outlet manifold including a nozzle mounted for axial twisting or rotation by a nozzle rotation assembly.

With this in mind, FIG. 13 illustrates a rotatable nozzle embodiment of a fluid effects platform 1300. The platform 1300 may be considered a modification of the platforms 100 and 1100 and similar components are labeled with like reference numbers (without descriptions being repeated at this point in the description). For example, the platform 1300 includes a drive assembly similar to that of platforms 100, 1100 for selectively pivoting 108 a fluid outlet manifold 1330 on a center point gimbal 122 on support 120. The platform 1300 includes a fluid inlet manifold 110 providing fluid input 102 via inlet 116 and hoses/tubing 136, 138 to body 132 and its inlets 134.

The fluid outlet manifold 1330 may utilize a nozzle manifold 1140 similar to that of platform 1100. In the configuration of platform 1300, one of the fluid outlets is capped such that manifold is not being used as a switching manifold but instead only as a fluid inlet to twisty or rotatable nozzle 1344 and structural or mounting structure for a nozzle rotation assembly 1370. In other words, fluid 102 flowing through the body 132 is fed into nozzle manifold 1140 and then to rotatable nozzle 1344.

As shown, the nozzle's inlet 1345 is in fluid communication with the manifold 1140 and is mounted such that it can be rotated (as shown with arrows 1349) in one or both directions about its center axis 1348 by rotation assembly 1370. A fluid seal (not shown) is provided, but the inlet member 1345 of nozzle 1344 is not rigidly affixed to outlet of the manifold 1140 such that it may rotate 1349 some predefined amount such as full rotation in some embodiments or some smaller amount (e.g., a back and forth twisting rather than continuous rotation about the rotation axis 1348).

A number of nozzle discharge members 1346 are provided and, during operation of the platform 1300, fluid 1347 is output or discharged from these members 1346 (three are shown but other numbers and designs may be utilized to practice platform 1300). When the rotation rate is zero, the nozzle 1344 is stationary and a first effect is achieved, but, when the nozzle 1344 is rotated at some rate greater than zero (e.g., up to 120 RPM or more), a second water display effect is provided by the platform 1300. The discharge members 1346 may be rigid and angled outward from central axis 1348 or the members 1346 may be flexible tubes or the like such that angle from axis 1348 varies with the rotation rate 1349 about the central axis 1348 to achieve differing and selectable water displays with the rotating nozzle 1344 (e.g., the nozzle may be thought of as a "dancer" nozzle). As with platform 1100, the rotatable nozzle 1344 extends up through the center of light ring assembly 150, which is typically rigidly affixed or mounted to the nozzle manifold 1140 or body 132 so as to pivot with the body 132 but not be rotated by nozzle rotation assembly 1370.

To provide selectable and controllable rotation (e.g., via control signals from a control system 710 running show/program software or the like), the platform 1300 includes a nozzle rotation assembly 1370. This assembly 1370 is provided as part of the fluid outlet manifold 1330 in that it is mounted (e.g., via mounting rods 1378) upon the nozzle manifold 1140 such that it pivots 108 and moves with the body 132 on center point gimbal 122. The assembly 1370 includes a drive motor 1372 (e.g., a servo motor or the like) with an output (e.g., a drive shaft or wheel) 1374, which is selectively rotated 1375 in either direction at a range or rates such as up to 120 RPM or more depending on the desired output effect with fluid 1347. A nozzle drive member 1376 such as a chain or belt mates with motor drive wheel 1374 and also with the nozzle inlet 1345. For example, the drive member 1376 may be a toothed or other flexible belt that moves in response to rotation 1375 of wheel 1374, and this movement of the belt 1367 causes the nozzle inlet 1345 to rotate 1349 about the nozzle rotation axis 1348.

Figure 14:
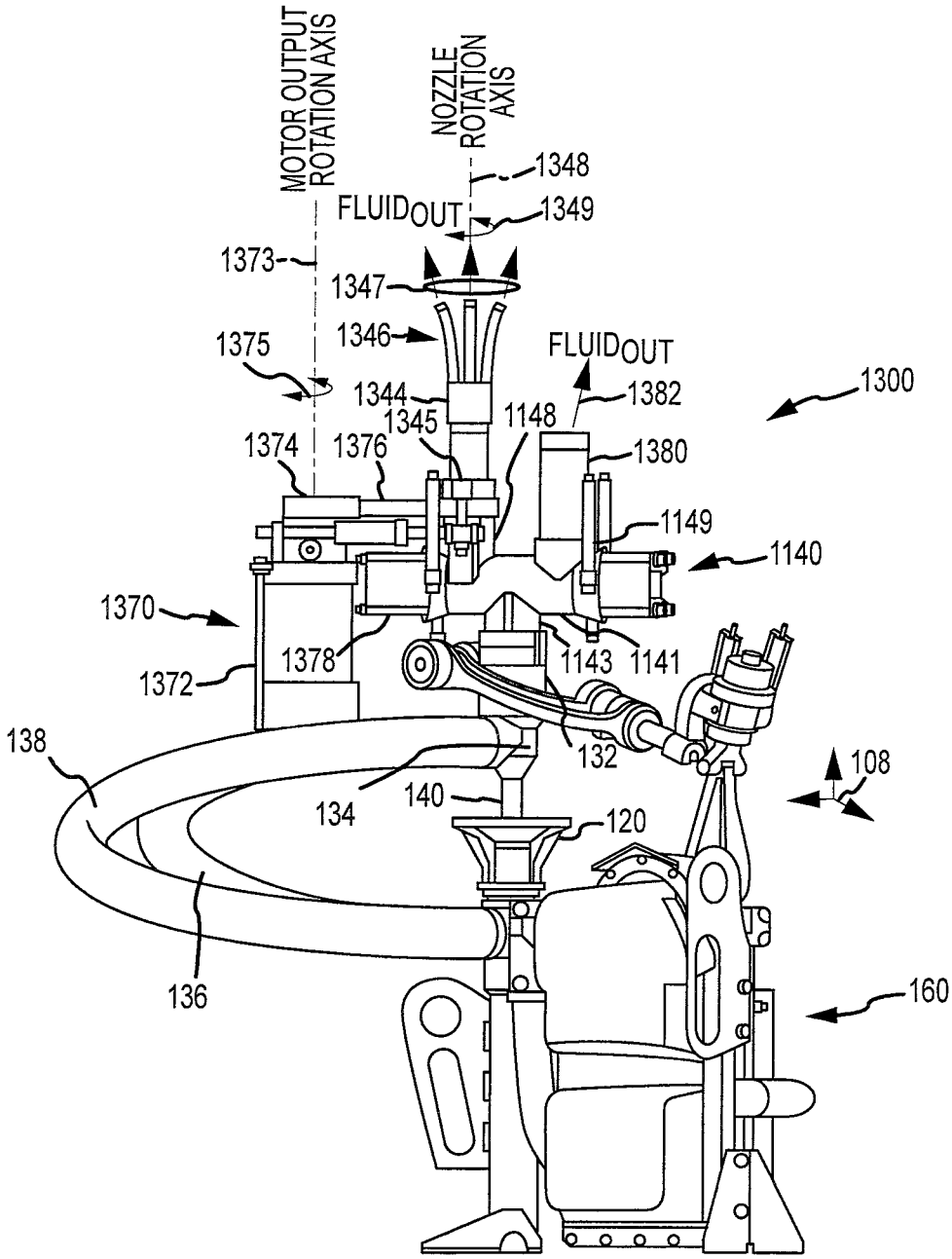
FIG. 14 illustrates a side view of the fluid effects platform modified to include an additional or second nozzle (a stationary or non-rotating nozzle) such that switching between the two nozzles may be selectively performed.

FIG. 14 illustrates a side view of the fluid effects platform 1300 reconfigured to provide a twisting nozzle 1344 in the fluid outlet manifold 1330 but to also include a still or stationary nozzle 1380 that can be selected by operation of nozzle manifold 1140. To this end, the rotatable nozzle 1344 has its inlet 1345 rotatably attached to the fluid outlet 1148 of the nozzle manifold body 1141 while the still nozzle 1380 is rigidly affixed to the fluid outlet 1149 of body 1141. The valve/diverter 1143 in body 1141 may be operated as discussed with reference to FIGS. 11 and 12 via pressurized air to switch between or select one of the outlets 1148, 1149 and nozzles 1344, 1380 to provide fluid out 1347, 1382. Hence, the platform 1300 may be thought of as a fluid effects platform adapted to allow remote switching between two or more nozzles with at least one of the nozzles 1344 also being selectively rotated or twisted 1349 about its axis 1348.

As shown in FIGS. 13 and 14, the motor 1372 is mounted over the hoses 136, 138 and proximate to the nozzle manifold 1140 (e.g., several inches or less form the end of the manifold body 1141). The motor output rotation axis 1373 about which the motor drive wheel 1374 rotates is parallel to the nozzle rotation axis 1348 and relatively close to the axis passing through the body 132. Further, motor 1372 and axis 1373 may be positioned at matching angular offsets from the arms of drive assembly 160, such as 120 degrees offset from each arm/drive of assembly 160. In this manner, the weight of the motor 1372 and other portions of nozzle drive assembly may be somewhat offset by portions of the drive assembly 160 or at least have the eccentric loading limited or reduced. Further, though, the eccentric loading is accounted for within control software of the platform control system (such as show commands 719 or the like in memory 718 of computer system 710 of the system of FIG. 7) such that the pivoting 108 and positioning/aligning of the fluid outlet manifold 1330 and its nozzles 1344, 1380 is effectively achieved.

Figure 15:
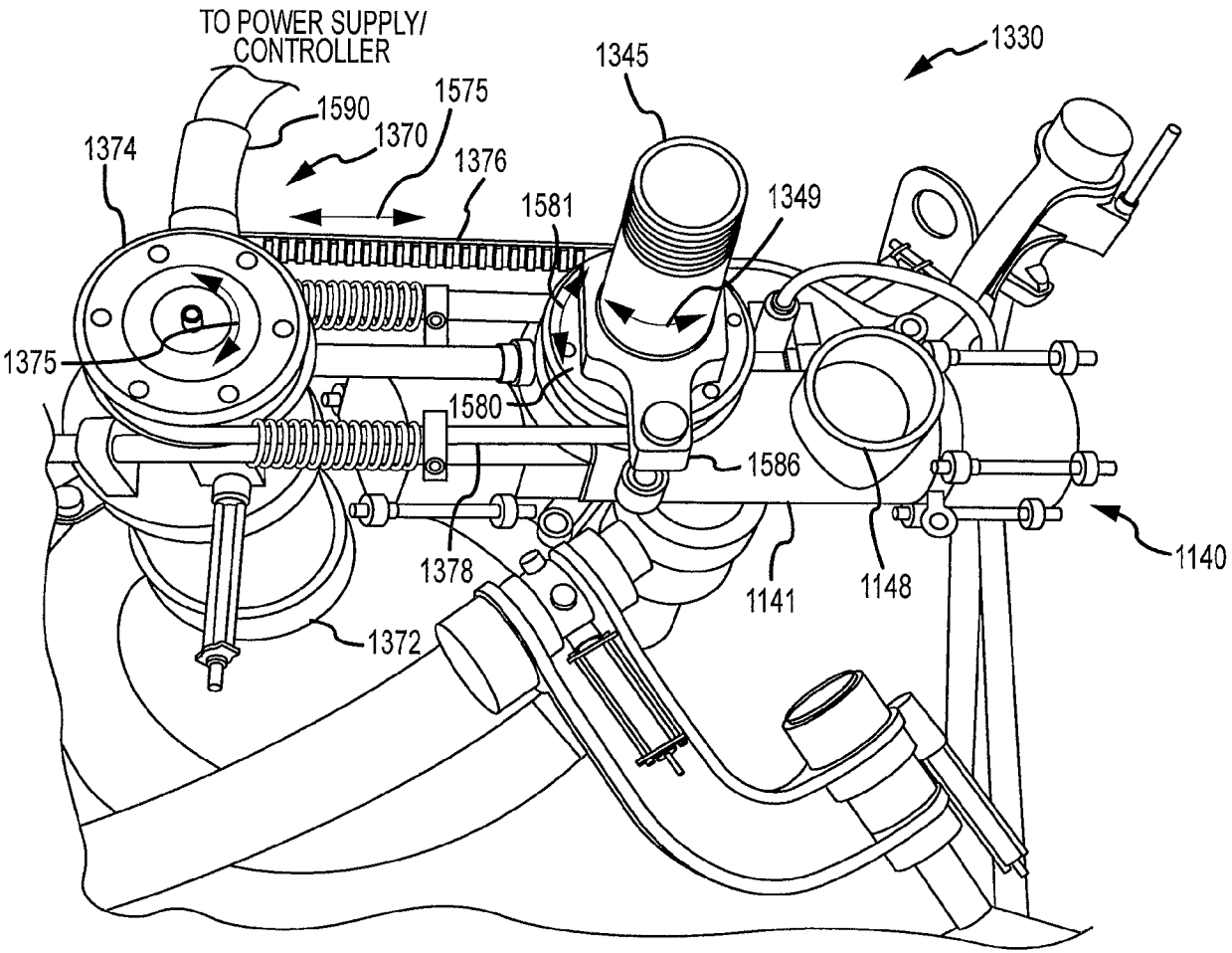
FIG. 15 is a partial top view of the fluid outlet manifold of the platforms of FIGS. 13 and 14 with the nozzles and light ring removed from the body of the fluid outlet manifold.

To provide further details of the nozzle-switching and nozzle-twisting platform 1300. FIG. 15 is included which shows a partial top view of the fluid outlet manifold 1330 with the light ring 150 and nozzles 1344, 1380 removed from the nozzle manifold 1140. As shown, a power/control line 1590 may be connected to the drive motor 1372 of nozzle rotation assembly 1370 to allow the motor (e.g., a servo motor or the like) to be controlled by an off-platform controller and to be powered via a remote power source/supply (e.g., motor may be but does not have to be battery powered so as to reduce weight of assembly 1370 and reduce maintenance costs).

During operations, the motor 1372 rotates the drive wheel 1374 as shown with arrow 1375. The rotation 1375 may be in either direction or alternate back and forth. Further, the rotation 1375 may be continuous in one direction, e.g., 360 degree rotation about the axis at one or more rotation rates or be varied, e.g., rotate through 10 full rotations in the clockwise direction and then rotate counterclockwise for 3 rotations and so on. The rotation in either direction may be at a single speed or at differing speeds, which may be set remotely by the main controller (not shown in FIG. 15) via line 1590 (or with wireless control signals in some embodiments of platform 1300).

Rotation 1375 of wheel 1374 causes the mating drive member 1376 (e.g., a toothed, flexible drive belt or the like) to move as shown with arrow 1575. This belt movement 1575, in turn, causes a second drive wheel 1580 interconnected with nozzle inlet 1345 to rotate 1581 so as to rotate 1349 the nozzle inlet 1345 about its central axis. The motor 1372 is mounted via mounting rods 1378 and collar 1586 to the body 1141 of the nozzle manifold 1140 such that it is rigidly supported in the fluid outlet manifold to move/pivot with the manifold 1140, which, in turn, is rigidly mounted to the body 132.

We claim:

1. A fluid effects apparatus, comprising:

a base with a center point gimbal mechanism; and a fluid outlet manifold with an inlet for receiving fluid, wherein the fluid outlet manifold is pivotally supported upon the center point gimbal mechanism, and wherein the fluid outlet manifold includes:

a nozzle manifold with a fluid outlet for dispersing the received fluid, a nozzle pivotally attached to the fluid outlet, and a nozzle drive assembly coupled to the nozzle and operating to selectively rotate the nozzle about a rotation axis passing through the nozzle, wherein the nozzle manifold further includes a second fluid outlet, a second nozzle coupled to the second fluid outlet, and switching means for selectively directing the received fluid to one of the fluid outlet and the second fluid outlet.

2. The apparatus of claim 1, wherein the nozzle drive assembly comprises a motor rigidly supported within the fluid outlet manifold to pivot with the fluid outlet manifold upon the center point gimbal mechanism and wherein an output drive element of the motor is coupled via a drive member to the nozzle.

3. The apparatus of claim 2, wherein the nozzle is selectively rotatable through a full 360-degree rotation about the rotation axis by the motor.

4. The apparatus of claim 1, wherein the switching means includes a controller positioned remote to the fluid outlet manifold that operates to select either the nozzle or the second nozzle for discharging the received fluid from the fluid outlet manifold.

5. The apparatus of claim 1, further comprising a drive assembly with a first drive mechanism driving an input arm attached to the fluid outlet manifold and a second drive mechanism driving an input arm attached to the fluid outlet manifold at a predefined offset angle relative to the input arm of the first drive mechanism, wherein the first and second drive mechanisms are separately and concurrently operable to move the input arms to pivot the fluid outlet manifold on the center point gimbal mechanism to selectively position the fluid outlet manifold.

6. The apparatus of claim 5, wherein the center point gimbal mechanism comprises a ball joint and wherein the fluid outlet manifold is rigidly connected to the ball joint.

7. The apparatus of claim 5, wherein the offset angle between the input arms is about 120 degrees.

8. The apparatus of claim 5, wherein the fluid outlet manifold has a range of motion on the center point gimbal mechanism that is a predefined angular offset in all directions from a center axis extending through the fluid outlet manifold.

9. The apparatus of claim 8, wherein the predefined angular offset is at least about 55 degrees.

10. The apparatus of claim 5, wherein the base comprises a fluid inlet manifold with an inlet for receiving pressurized fluid and at least two outlets for discharging the received pressurized fluid, further including at least two flexible hoses connecting the at least two outlets to the inlet of the fluid outlet manifold, and wherein the hoses have a center of gravity that is positioned at an offset angle of about 120 degrees from the input arms of the drive mechanisms.

11. A water display assembly, comprising:

a fluid inlet manifold with a fluid inlet and a pair of fluid outlets;

a fluid outlet manifold with a pair of fluid inlets and first and second nozzles for discharging fluid received via the fluid inlets, the fluid outlet manifold being pivotally mounted upon the fluid inlet manifold at a position above the fluid outlets;

a pair of flexible hoses connected to the fluid outlets and the fluid inlets; and a drive assembly comprising first and second drive aims attached to the fluid outlet manifold, wherein the fluid outlet manifold includes a switching mechanism for selecting the first nozzle or the second nozzle to discharge the received fluid.

12. The assembly of claim 11, wherein the switching mechanism operates in response to remote control signals from a control system to perform in the selecting of the first and second nozzles.

13. The assembly of claim 11, wherein the first nozzle is pivotally mounted within the fluid outlet manifold and wherein the fluid outlet manifold further comprises a drive assembly operating to rotate the first nozzle about a rotation axis.

14. The assembly of claim 13, wherein the drive assembly comprises a motor remotely operable to rotate the first nozzle via a drive member coupled to the first nozzle and wherein the first nozzle is rotatable at least in one direction through a full rotation of 360 degrees about the rotation axis.

15. The assembly of claim 11, wherein the drive arms are offset from each other by about 120 degrees as measured relative to a center axis of the outlet manifold, wherein the drive assembly further includes a pair of drive mechanisms operable to move the drive arms to articulate and selectively position the first and second nozzles, and wherein the drive mechanisms comprise motors that are independently and concurrently operable to move the drive arms to position the first and second nozzles.

16. The assembly of claim 15, wherein the drive arms each comprise a pair of swing arms and wherein the drive mechanisms each comprise motors providing angular motion to a drive plate linked to the swing arms.

17. A fluid effects apparatus, comprising:

a base with a center point gimbal mechanism; and a fluid outlet manifold with an inlet for receiving fluid, wherein the fluid outlet manifold is pivotally supported upon the center point gimbal mechanism, wherein the fluid outlet manifold includes:

a nozzle manifold with a first fluid outlet for dispersing the received fluid, a first nozzle pivotally attached to the first fluid outlet, and a nozzle drive assembly coupled to the first nozzle and operating to selectively rotate the first nozzle, and wherein the nozzle manifold further includes a second fluid outlet, a second nozzle coupled to the second fluid outlet, and a switch for selectively directing the received fluid to either the first fluid outlet or the second fluid outlet.

18. The apparatus of claim 17, further comprising a drive assembly with a first drive mechanism driving an input arm attached to the fluid outlet manifold and a second drive mechanism driving an input arm attached to the fluid outlet manifold at a predefined offset angle from the input arm of the first drive mechanism, wherein the first and second drive mechanisms are separately and concurrently operable to move the input arms to pivot the fluid outlet manifold on the center point gimbal mechanism to selectively position the fluid outlet manifold.

19. The apparatus of claim 17, wherein the nozzle drive assembly comprises a motor rigidly supported within the fluid outlet manifold to pivot with the fluid outlet manifold upon the center point gimbal mechanism and wherein an output drive element of the motor is coupled via a drive member to the first nozzle to selectively rotate the first nozzle.

20. A fluid effects apparatus, comprising:

a base with a center point gimbal mechanism; and a fluid outlet manifold with an inlet for receiving fluid, wherein the fluid outlet manifold is pivotally supported upon the center point gimbal mechanism, and wherein the fluid outlet manifold includes:

a nozzle manifold with a fluid outlet for dispersing the received fluid, a nozzle pivotally attached to the fluid outlet, and a nozzle drive assembly coupled to the nozzle and operating to selectively rotate the nozzle about a rotation axis passing through the nozzle, wherein the fluid effects apparatus further includes a drive assembly with a first drive mechanism driving an input arm attached to the fluid outlet manifold and a second drive mechanism driving an input arm attached to the fluid outlet manifold at a predefined offset angle relative to the input arm of the first drive mechanism, wherein the first and second drive mechanisms are separately and concurrently operable to move the input arms to pivot the fluid outlet manifold on the center point gimbal mechanism to selectively position the fluid outlet manifold, wherein the center point gimbal mechanism comprises a ball joint, and wherein the fluid outlet manifold is rigidly connected to the ball joint.

21. The apparatus of claim 20, wherein the nozzle drive assembly comprises a motor rigidly supported within the fluid outlet manifold to pivot with the fluid outlet manifold upon the center point gimbal mechanism and wherein an output drive element of the motor is coupled via a drive member to the nozzle.

22. The apparatus of claim 21, wherein the nozzle is selectively rotatable through a full 360-degree rotation about the rotation axis by the motor.

23. The apparatus of claim 20, wherein the fluid outlet manifold has a range of motion on the center point gimbal mechanism that is a predefined angular offset in all directions from a center axis extending through the fluid outlet manifold.

24. The apparatus of claim 23, wherein the predefined angular offset is at least about 55 degrees.

25. A fluid effects apparatus, comprising:

a base with a center point gimbal mechanism; and a fluid outlet manifold with an inlet for receiving fluid, wherein the fluid outlet manifold is pivotally supported upon the center point gimbal mechanism, and wherein the fluid outlet manifold includes:

a nozzle manifold with a fluid outlet for dispersing the received fluid, a nozzle pivotally attached to the fluid outlet, and a nozzle drive assembly coupled to the nozzle and operating to selectively rotate the nozzle about a rotation axis passing through the nozzle, wherein the fluid effects apparatus further includes a drive assembly with a first drive mechanism driving an input arm attached to the fluid outlet manifold and a second drive mechanism driving an input arm attached to the fluid outlet manifold at a predefined offset angle relative to the input arm of the first drive mechanism, wherein the first and second drive mechanisms are separately and concurrently operable to move the input arms to pivot the fluid outlet manifold on the center point gimbal mechanism to selectively position the fluid outlet manifold, and wherein the offset angle between the input arms is about 120 degrees.

26. The apparatus of claim 25, wherein the nozzle drive assembly comprises a motor rigidly supported within the fluid outlet manifold to pivot with the fluid outlet manifold upon the center point gimbal mechanism and wherein an output drive element of the motor is coupled via a drive member to the nozzle.

27. The apparatus of claim 26, wherein the nozzle is selectively rotatable through a full 360-degree rotation about the rotation axis by the motor.

28. The apparatus of claim 25, wherein the fluid outlet manifold has a range of motion on the center point gimbal mechanism that is a predefined angular offset in all directions from a center axis extending through the fluid outlet manifold and wherein the predefined angular offset is at least about 55 degrees.

29. A fluid effects apparatus, comprising:

a base with a center point gimbal mechanism; and a fluid outlet manifold with an inlet for receiving fluid, wherein the fluid outlet manifold is pivotally supported upon the center point gimbal mechanism, and wherein the fluid outlet manifold includes:

a nozzle manifold with a fluid outlet for dispersing the received fluid, a nozzle pivotally attached to the fluid outlet, and a nozzle drive assembly coupled to the nozzle and operating to selectively rotate the nozzle about a rotation axis passing through the nozzle, wherein the fluid effects apparatus further includes a drive assembly with a first drive mechanism driving an input arm attached to the fluid outlet manifold and a second drive mechanism driving an input arm attached to the fluid outlet manifold at a predefined offset angle relative to the input arm of the first drive mechanism, wherein the first and second drive mechanisms are separately and concurrently operable to move the input arms to pivot the fluid outlet manifold on the center point gimbal mechanism to selectively position the fluid outlet manifold, and wherein the base comprises a fluid inlet manifold with an inlet for receiving pressurized fluid and at least two outlets for discharging the received pressurized fluid, further including at least two flexible hoses connecting the at least two outlets to the inlet of the fluid outlet manifold, and wherein the hoses have a center of gravity that is positioned at an offset angle of about 120 degrees from the input arms of the drive mechanisms.

30. The apparatus of claim 29, wherein the nozzle drive assembly comprises a motor rigidly supported within the fluid outlet manifold to pivot with the fluid outlet manifold upon the center point gimbal mechanism and wherein an output drive element of the motor is coupled via a drive member to the nozzle.

31. The apparatus of claim 30, wherein the nozzle is selectively rotatable through a full 360-degree rotation about the rotation axis by the motor.

32. The apparatus of claim 29, wherein the fluid outlet manifold has a range of motion on the center point gimbal mechanism that is a predefined angular offset in all directions from a center axis extending through the fluid outlet manifold and wherein the predefined angular offset is at least about 55 degrees.

* * * * *

UNITED STATES PATENT AND TRADEMARK OFFICE

CERTIFICATE OF CORRECTION

PATENT NO. : 8,459,573 B2
APPLICATION NO. : 13/026504
DATED : June 11, 2013
INVENTOR(S) : Evelyn S. Wiseman et al.

It is certified that error appears in the above-identified patent and that said Letters Patent is hereby corrected as shown below:

In the Claims

Column 20, lines 3-17 please replace claim 11 with the following rewritten claim:

--11. A water display assembly, comprising:
a fluid inlet manifold with a fluid inlet and a pair of fluid outlets;
a fluid outlet manifold with a pair of fluid inlets and first and second nozzles for discharging fluid received via the fluid inlets, the fluid outlet manifold being pivotally mounted upon the fluid inlet manifold at a position above the fluid outlets;
a pair of flexible hoses connected to the fluid outlets and the fluid inlets; and
a drive assembly comprising first and second drive arms attached to the fluid outlet manifold, wherein the fluid outlet manifold includes a switching mechanism for selecting the first nozzle or the second nozzle to discharge the received fluid.--

Column 20, lines 18-21 please replace claim 12 with the following rewritten claim:

--12. The assembly of claim 11, wherein the switching mechanism operates in response to remote control signals from a control system to perform the selecting of the first and second nozzles.--

Signed and Sealed this
Sixth Day of August, 2013

Teresa Stanek Rea
*Acting Director of the United States Patent and Trademark Office*